US010232212B1

(12) United States Patent
Cohen

(10) Patent No.: US 10,232,212 B1
(45) Date of Patent: Mar. 19, 2019

(54) EXERCISE APPARATUS, STUDIO, AND METHODS

(71) Applicant: Franci Cohen, Brooklyn, NY (US)

(72) Inventor: Franci Cohen, Brooklyn, NY (US)

(73) Assignee: Franci Cohen, Brooklyn, NY (US)

( * ) Notice: Subject to any disclaimer, the term of this patent is extended or adjusted under 35 U.S.C. 154(b) by 0 days.

(21) Appl. No.: 14/253,407

(22) Filed: Apr. 15, 2014

Related U.S. Application Data

(60) Provisional application No. 61/969,819, filed on Mar. 24, 2014.

(51) Int. Cl.
*A63B 21/055* (2006.01)

(52) U.S. Cl.
CPC ..... *A63B 21/0552* (2013.01)

(58) Field of Classification Search
CPC .... A63B 7/00; A63B 7/02; A63B 7/04; A63B 7/045; A63B 7/08; A63B 7/085; A63B 21/0004; A63B 21/00043; A63B 21/00061; A63B 21/00065; A63B 21/00076; A63B 21/00185; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/15; A63B 21/151; A63B 21/16; A63B 21/1609; A63B 21/1618; A63B 21/1627; A63B 21/1636; A63B 21/1645; A63B 21/1654; A63B 21/1663; A63B 21/1672; A63B 21/1681; A63B 21/169; A63B 21/4001; A63B 21/4019; A63B 21/4021; A63B 21/4023; A63B 21/4025; A63B 21/4033; A63B 21/4034; A63B 21/4035; A63B 21/4037; A63B 21/4043; A63B 26/00; A63B 26/003; A63B 71/02;
(Continued)

(56) References Cited

U.S. PATENT DOCUMENTS

D267,419 S 12/1982 Komarnicki
D287,868 S 1/1987 Whaley
(Continued)

FOREIGN PATENT DOCUMENTS

WO 2012071061 A1 5/2012
WO WO 2012071061 A1 * 5/2012 ..... A63B 21/00065

OTHER PUBLICATIONS

Spiderbands by Worldlibertytv1 dated Nov. 23, 2014. Found on line [Apr. 13, 2016] https://www.youtube.com/watch?v=862DWR7Rm7A.
Spiderbands by Franc Cohen dated no date given, found on line [Nov. 12, 2015] http://www.francicohen.com/spiderbands.html.

*Primary Examiner* — Gary D Urbiel Goldner

(57) ABSTRACT

Provided is an exercise studio configuration including a floor, at least one overhead support, and at least one pair of resilient bands hanging from the at least one overhead support at a first end of each of the resilient bands. Each of the resilient bands has a free end distal to the first end and a connection member adapted for the connection of user accessories between the first end and the free end, the resilient bands being resilient between the first end and the free end with a consistent spring constant. A glove may be attached simultaneously at two locations thereof to the free end of at least one of the pair of resilient bands.

19 Claims, 22 Drawing Sheets

(58) Field of Classification Search
CPC . A63B 71/023; A63B 71/04; A63B 2071/026; A63B 2071/027; A63B 2210/10; A63B 2225/09; A63B 2225/093; A63B 2244/12
See application file for complete search history.

(56) References Cited

U.S. PATENT DOCUMENTS

D300,157 S 3/1989 Yates
D302,194 S 7/1989 Charnitski
D320,823 S 10/1991 Tanner
D324,708 S 3/1992 Walsh
D330,398 S 10/1992 Bale
5,178,590 A * 1/1993 Stephens ..... A63B 7/02 482/23
5,205,803 A * 4/1993 Zemitis ..... A63B 21/0552 482/121
5,209,712 A * 5/1993 Ferri ..... A61H 1/02 482/131
D337,133 S 7/1993 Olsen et al.
D339,835 S 9/1993 Hsieh
5,277,683 A * 1/1994 Wilkins ..... A63B 21/0552 482/121
5,306,222 A * 4/1994 Wilkinson ..... A41D 13/0015 482/121
5,372,556 A 12/1994 Ropp
5,407,404 A 4/1995 Killian et al.
D372,059 S 7/1996 Taylor
5,746,684 A 5/1998 Jordan
5,984,792 A * 11/1999 Clark ..... A63G 9/14 472/118
5,997,448 A * 12/1999 Duba ..... A63B 21/0552 482/121
6,202,263 B1 * 3/2001 Harker ..... B62J 7/08 114/230.2
6,554,747 B1 * 4/2003 Rempe ..... A63B 21/04 482/38
D488,544 S 4/2004 Akaltan
6,776,317 B1 * 8/2004 Parker ..... A45F 5/00 224/250
D503,757 S 4/2005 Sjurdagardi
7,032,529 B2 * 4/2006 Sanford ..... F16F 7/006 114/230.2
D544,050 S 6/2007 Webber
D578,582 S 10/2008 Gomez
D580,257 S 11/2008 Squyres
7,458,135 B2 * 12/2008 Mikesell ..... B25H 3/006 24/300
D586,435 S 2/2009 Reckseen
D597,788 S 8/2009 Ellis
7,695,413 B1 4/2010 Cruz et al.
D618,536 S 6/2010 Eason
7,744,512 B2 * 6/2010 Clarke ..... A63B 23/1209 482/124
7,794,374 B1 * 9/2010 Park ..... A63B 21/0004 482/122
D629,472 S 12/2010 Rhodes
7,909,748 B2 * 3/2011 Calvagne ..... A63B 7/02 482/143
D657,008 S 4/2012 Markovic
D698,402 S 1/2014 Saletta
D707,536 S 6/2014 Van Riper
8,784,284 B1 * 7/2014 Smith ..... A47D 13/08 482/121
D723,116 S 2/2015 Gillespie
D731,032 S 6/2015 Yang
D741,419 S 10/2015 Cohen
2001/0034291 A1 * 10/2001 Horton ..... A63B 21/0552 482/124
2002/0022555 A1 * 2/2002 Nesci ..... A63B 21/4021 482/91
2003/0078142 A1 * 4/2003 Jacobsen ..... A63B 21/0552 482/126
2005/0026757 A1 * 2/2005 Creary ..... A63B 5/16 482/143
2005/0070408 A1 3/2005 Fallacaro
2005/0124471 A1 * 6/2005 Wilkinson ..... A63B 22/0005 482/121
2006/0052222 A1 * 3/2006 Cardenas ..... A61H 1/0229 482/96
2007/0032357 A1 2/2007 Piane
2007/0039086 A1 2/2007 Moore
2007/0232468 A1 10/2007 Levy et al.
2008/0214369 A1 * 9/2008 Mancini ..... A63B 21/04 482/121
2009/0061198 A1 * 3/2009 Khambete ..... A63B 6/02 428/223
2009/0075789 A1 * 3/2009 Hetrick ..... A63B 21/0023 482/91
2010/0130336 A1 * 5/2010 McSorley ..... A63B 21/0552 482/110
2010/0292056 A1 * 11/2010 Birch ..... A63B 21/00185 482/129
2011/0124477 A1 * 5/2011 Davis ..... A63B 21/068 482/143
2011/0172064 A1 * 7/2011 Cutler ..... A63B 21/0552 482/63
2011/0251033 A1 10/2011 Blancher
2012/0197168 A1 * 8/2012 Agrawal ..... A61H 3/008 602/19
2012/0202662 A1 * 8/2012 DeMarco ..... A63B 1/00 482/143
2012/0267403 A1 10/2012 Ward, Jr.
2012/0270706 A1 * 10/2012 Wu ..... A63B 7/02 482/91
2012/0329618 A1 * 12/2012 White ..... A63B 21/0552 482/126
2012/0329620 A1 * 12/2012 White ..... A63B 21/151 482/131
2013/0045842 A1 2/2013 Wood
2013/0143724 A1 * 6/2013 DeMeo ..... A63B 21/00185 482/131
2013/0157821 A1 * 6/2013 Crowell ..... A63B 21/0442 482/129
2013/0165301 A1 * 6/2013 Thrasher-Rudd ..... A63B 7/00 482/129
2014/0051549 A1 * 2/2014 Hunter ..... A63B 7/02 482/24
2014/0073496 A1 * 3/2014 Bannerman ..... A63B 21/0552 482/139
2014/0087928 A1 * 3/2014 Luedeka ..... A63B 21/4023 482/130
2014/0155229 A1 * 6/2014 Nikkaran ..... A63B 21/068 482/99
2014/0155233 A1 * 6/2014 Latronica ..... A63B 21/0442 482/124
2014/0274569 A1 * 9/2014 Lewen ..... A63B 7/02 482/24
2014/0274607 A1 9/2014 Kaye
2014/0336016 A1 * 11/2014 Hernendez ..... A63B 21/4043 482/93
2015/0005141 A1 * 1/2015 Krahling ..... A63B 21/0442 482/124
2015/0105186 A1 * 4/2015 Block ..... A63B 71/04 473/416
2015/0126348 A1 5/2015 Kaye et al.
2015/0133277 A1 * 5/2015 Alexandrov ..... A63B 23/03525 482/131
2015/0141217 A1 * 5/2015 Young ..... A63B 21/0442 482/126
2015/0148204 A1 * 5/2015 Sleppy ..... A63B 21/4043 482/139
2015/0238799 A1 * 8/2015 Arline ..... A63B 21/0442 482/129
2015/0335937 A1 * 11/2015 Park ..... A63B 21/0555 482/121

* cited by examiner

EXERCISE APPARATUS, STUDIO, AND METHODS

CROSS-REFERENCE TO RELATED APPLICATIONS

The present application claims the benefit of U.S. Provisional Application Ser. No. 61/969,819 filed Mar. 24, 2014, the disclosure of which is hereby incorporated by reference herein.

BACKGROUND OF THE INVENTION

The present invention relates to exercise apparatuses, exercise studios, and methods of use of the apparatuses, including both inside and outside of the inventive studio.

Studio exercise facilities and classes are ubiquitous throughout the United States and the world, and many individuals participate in these classes weekly or even daily. Studios used to host these classes have largely remained unchanged over the years. For example, many exercise classes are held in studios with wood floors, similar to those of a basketball court. Others are held on floors padded with tumbling mats while still further are held on floors with rubber mats. These studios have been found lacking for certain activities.

Additionally, various fitness apparatuses have been used in these studios. Many of these apparatuses become fitness fads, gaining wild popularity for months or perhaps years before fading into staleness and obsolescence.

BRIEF SUMMARY OF THE INVENTION

It would therefore be beneficial to provide an exercise apparatus that could be used alone, or with a variety of other apparatuses known or to be invented, so as to avoid staleness and obsolescence. It would also be advantageous to provide an exercise studio that can accommodate this apparatus and the exercises that such an apparatus enables. The EXERCISE APPARATUS, STUDIO, AND METHODS provided herein address these and other needs.

In accordance with aspects of the invention, an exercise band system comprises a resilient resistance band with a first end and a second end, the resilient resistance band having an untensioned length, and the resilient resistance band being expandable in length upon application of tensioning force thereon. A covering is placed over at least a portion of the resilient resistance band, the covering being gathered when the resilient resistance band is in the untensioned length and being at least less gathered when the elongate resistance band is expanded in length. A first connection member is located at the first end of the exercise band and second and third connection members are located at the second end of the exercise band. A fourth connection member is located between the first end and the second end of the exercise band.

The exercise band system may further comprise a fifth connection member between the first end and the second end of the exercise band. The fourth and fifth connection members may be attached directly to the covering.

The exercise band system may further comprise a fifth connection member between the first end and the second end of the exercise band and the fourth and fifth connection members may be located closer to the first connection member than the second and third connection members.

At least one of the first, second, third, and fourth connection members may include a carabineer.

The covering may remain gathered upon application of 130 pounds of tensile force.

The covering may remain gathered upon application of 250 pounds of tensile force.

The exercise band system may further comprise a glove having first and second attachment points, the first and second attachment points being adapted to connect to the second and third attachment members, respectively.

The exercise band system may further comprise additional apparatuses, the additional apparatuses being selected from the group consisting of a stationary bicycle, an exercise dome, a rebounder, and a heavy bag.

In accordance with other aspects of the present invention, a method of exercising a participant utilizing a pair of overhead supported resilient bands is provided, where each resilient band has first and second connection members at its free end, the method comprising configuring the free end of a first of the pair of exercise bands to support the lower left leg of a participant above the floor, configuring the free end of a second of the pair of the exercise bands to support the lower right leg of a participant above the floor, and instructing the participant to place her hands on the floor such that the participant is positioned in a floating plank position.

The method may further comprise instructing the participant to move to a floating pike position.

The method may further comprise instructing the participant to perform repetitive floating plank jacks.

The step of configuring the free end of a first of the pair of exercise bands to support the lower leg of a participant may include attaching a handle to the free end.

A participant may be a plurality of participants and a pair of bands may be a pair of bands per participant.

In a further aspect of the present invention, an exercise studio configuration comprises a floor, at least one overhead support, multiple pairs of resilient bands hanging from the at least one overhead support, each of the bands having a free end and a connection member between the overhead support and the free end.

The at least one overhead support may be self-standing supports. The at least one overhead support may also be a ceiling.

The floor may be a martial arts floor, such as a polyurethane floor.

The multiple pairs of resilient bands may be arranged in rows. If so arranged, the pairs of resilient bands in adjacent rows may be offset from one another.

The exercise studio configuration may further comprise a stationary cycle associated with at least some of the multiple pairs of resilient bands.

BRIEF DESCRIPTION OF THE DRAWING FIGURES

DETAILED DESCRIPTION

Figure 1:
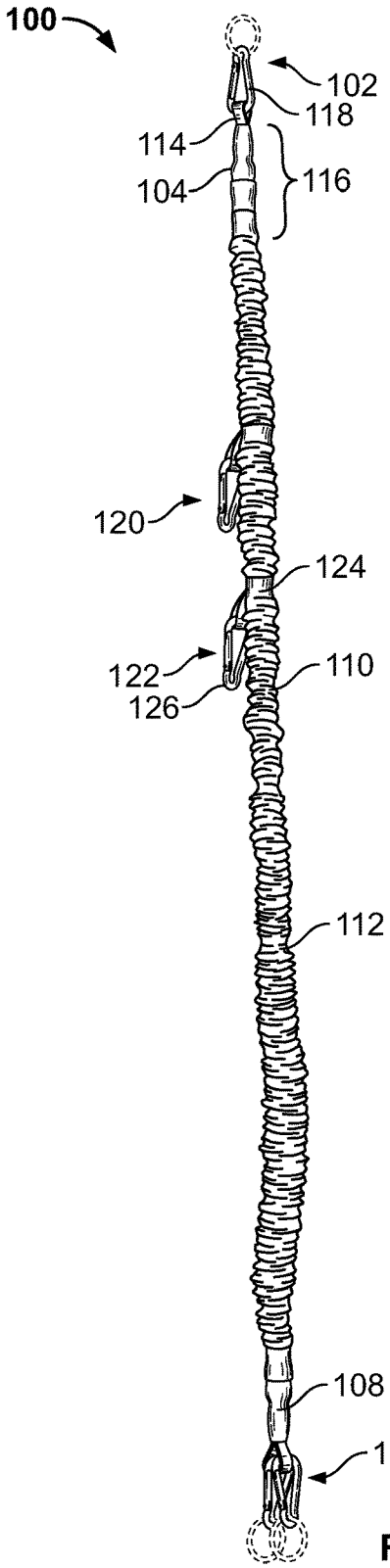
FIG. 1 depicts a perspective view of an exercise band in accordance with one embodiment of the present invention.

In the following are described the preferred embodiments of the EXERCISE APPARATUS, STUDIO, AND METHODS of the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose. Where like elements have been depicted in multiple embodiments, identical or similar reference numerals have been used in the multiple embodiments for ease of understanding.

Figure 2:
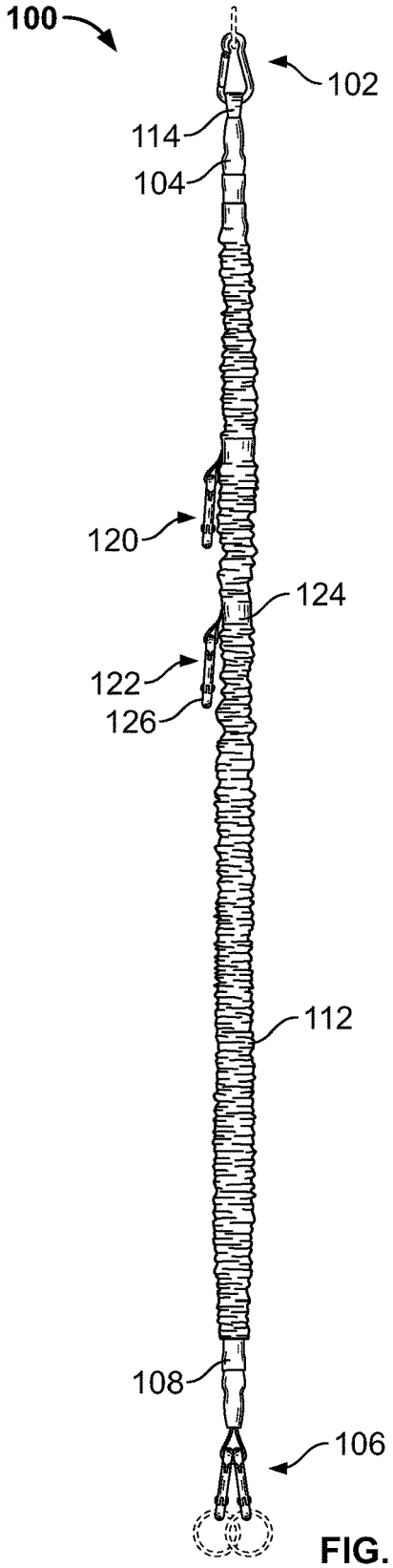
FIG. 2 depicts a front view of the exercise band of FIG. 1.

While details of the invention may be appreciated by considering the entirety of the submission, this detailed description begins with a discussion of one embodiment of an exercise apparatus, referred hereto as an exercise band 100, shown in a preferred embodiment in FIGS. 1 and 2. The exercise band 100 is generally configured as an elongate length of material with connection mechanisms on either ends. Accordingly, a first connection mechanism 102 is provided at a first end 104 of the exercise band 100 and a second attachment mechanism 106 is located at a second end 108 of the exercise band. Spanning the first end 104 and the second end 108 of the exercise band 100 is the exercise band body 110.

The exercise band body 110, in the preferred embodiment, is configured of one or more resistance bands (not shown in FIG. 1 or 2) at least partially covered with a fabric covering 112, preferably an industrial fabric of considerable strength and wear resistance such as a nylon covering overtop of the entire resistance band. As shown in FIG. 1, the fabric covering 112 is "gathered" such that the fabric covering is compressed when there is no tension on the resistance band. The covering 112 may also be non-continuous with sections that are of different materials where there may be no cover at all.

Upon application of tension between the first end 104 and second end 108 of the exercise band 100, the resistance band extends and the "gatherings" of the fabric covering 112 become less pronounced such that the fabric "ungathers" as the exercise band elongates to a fully extended length. In other embodiments no fabric covering 112 may be used and the resistance band may be exposed. In some embodiments, the excursion limit of the exercise band 100 may be limited by the fabric covering 112, such that the resistance band is not permitted to reach its fully tensioned length.

As used herein, resistance bands shall be understood to include any material that may serve the function of resiliency within the fabric covering 112. Such materials and items may include, or be referred to conventionally, as latex resistance bands, shock cord, resistance bands, fitness tube, or resistance cords. Even conventional metal springs and such could be utilized. The preferred material, however, is a single latex resistance band. Regardless of the material, it should be understood that multiple internal bands may be used, where the bands are of the same or differing materials, performance characteristics, and/or un-extended lengths. Moreover, it will be appreciated that the internal resistance band may include a covering, such as a cloth covering, intermediate to the fabric covering 112.

It will also be appreciated that the exercise band's dynamic force capability should account for the tension load of participant, particularly the buoyancy of a participant as the participant moves through the various exercises embodied in the invention.

Using the first attachment mechanism 102 as an example, each attachment mechanism 102, 106 may include an attachment means such as a ring, loop, clasp, carabineer, or the like for attaching components of the exercise band 100. In FIG. 1, ring 114 is provided. The ring 114 is connected to the resistance band interior to the fabric covering 112 such as by tying or otherwise fusing the resistance band to the ring. Covering and protecting that tied or fused connection point is a surround, typically configured as a tight rubber sleeve 116. It will be appreciated that the fabric covering 112 is tucked under the rubber sleeve 116, at least for aesthetic reasons. Likewise, the ring 114 is partially covered by the rubber sleeve 116. Attached to the ring 114 may be one or more connection members, such as a carabineer 118. Other connection members include rings, loops, clasps, and the like. In a preferred embodiment, there is one carabineer at the first end 104 of the exercise band 100 and two carabineers at the second end 108 of the exercise band. Although two carabineers may be provided at the second end 108 of the exercise band 100, depending on the apparatus in which the exercise band is intended to be attached to, only one of the two carabineers may be used instead of both.

In the embodiment shown in FIG. 1, along the length of the body 110 of the exercise band 100 are two additional attachment mechanisms 120, 122. These attachment mechanisms 120, 122 are formed by connecting a length of fabric 124 or other material, such as by sewing, chemical bonding, or the like, to the fabric covering 112. The length of fabric 124 is then sewn directly around an attachment mechanism such as a carabineer 126 shown, or a ring, hook, or other similar device. In other embodiments, intermediary components such as a ring may be provided.

The attachment mechanisms 120, 122 may include fastening means, such as hook and loop type fasteners, snaps, or the like (not shown), for preventing the attachment mechanisms 120, 122 from waving freely and to secure same to the body 110 of the exercise band 100, particularly when not in use.

Appreciably these attachment mechanisms 120, 122 are preferably located approximately ⅔ of the length of the exercise band 100 from the second end 108 and are preferably spaced apart by under 12-inches. In terms of overall dimensions, it will be appreciated that the exercise band 100 may be configured to virtually any length, but a preferred length is one that will enable the first end 102 of the exercise band 100 to be connected to a ceiling or other overhead support structure (such as a freestanding overhead support structure) while the free end, or second end 108, hangs approximately between waist and shoulder level of a user. For some applications hanging just above shoulder height is preferred. As such, and merely as an example, an exercise band 100 configured for a 10' ceiling and a typical user may be between approximately 5'-0" and 6'-0" in untensioned length. Upon tensioning, the length will change.

As mentioned previously, the exercise band 100 is preferably configured with a resistance band interior to the fabric covering 112. Preferably, the resistance band is resilient, yet engineered to be fully capable of supporting the weight of a human exercise participant in a tensioned configuration. In order to accommodate human exercise participants of various weights, different strength exercise bands may be provided. For example, in a two component system, a first exercise band may be configured to support a typical participant between 100 and 140 pounds and a second exercise band may be configured to support a typical participant greater than 140 pounds (of course other ranges may be provided), such as up to 250 pounds. Preferably, the resilient strength of an exercise band 100 is such that a participant can effectively stretch the exercise band upon tensioning but not so great that the "gatherings" of the fabric covering 112 are made fully taught upon full weight bearing of the participant. Thus the exercise band preferably remains resilient, and not fully lengthened, through its tensioned length.

Other embodiments of the exercise band may result in an exercise band that is non-resilient. In such case, rather than an internal resistance band, the exercise band may be configured with an internal non-resilient member such as a rope, wire, chain, nylon strap, or the like. Similarly, the fabric covering may not be utilized in such a situation. Here, the exercise band could otherwise be configured similarly with attachment mechanisms on either end as well as one or more intermediate attachment mechanisms.

Figure 3:
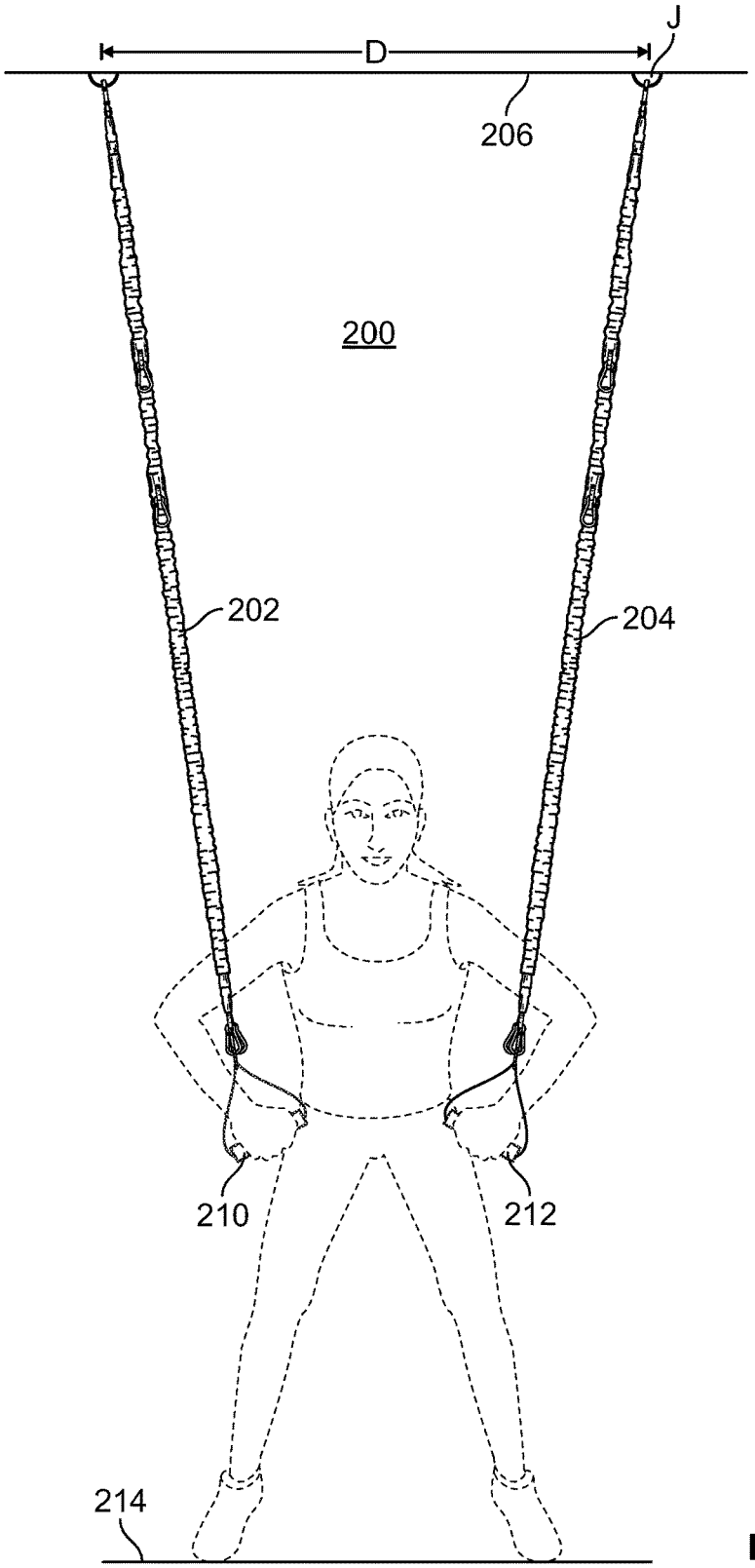
FIG. 3 depicts a frontal view of a participant utilizing embodiments of the exercise bands and studio of the present invention.

FIG. 3 shows a front view of a studio 200 where exercise bands may be used. As shown, the studio includes a first exercise band 202 and a second exercise band 204 extending downward from an overhead supporting member, such as a ceiling 206 of the studio or other supporting structure which may be built into the studio or portable and freestanding. A participant 208 is shown grasping the exercise bands 202, 204, which are configured in this example with handles 210, 212, while standing on a floor 214.

Because the exercise bands 202, 204 are designed to support the full body weight of the participant 208, they should be attached to a structural member, such as the ceiling 206, in such a manner as to provide adequate support. Here, the exercise bands 202, 204 are attached directly to joists J of the studio ceiling.

Figure 4:
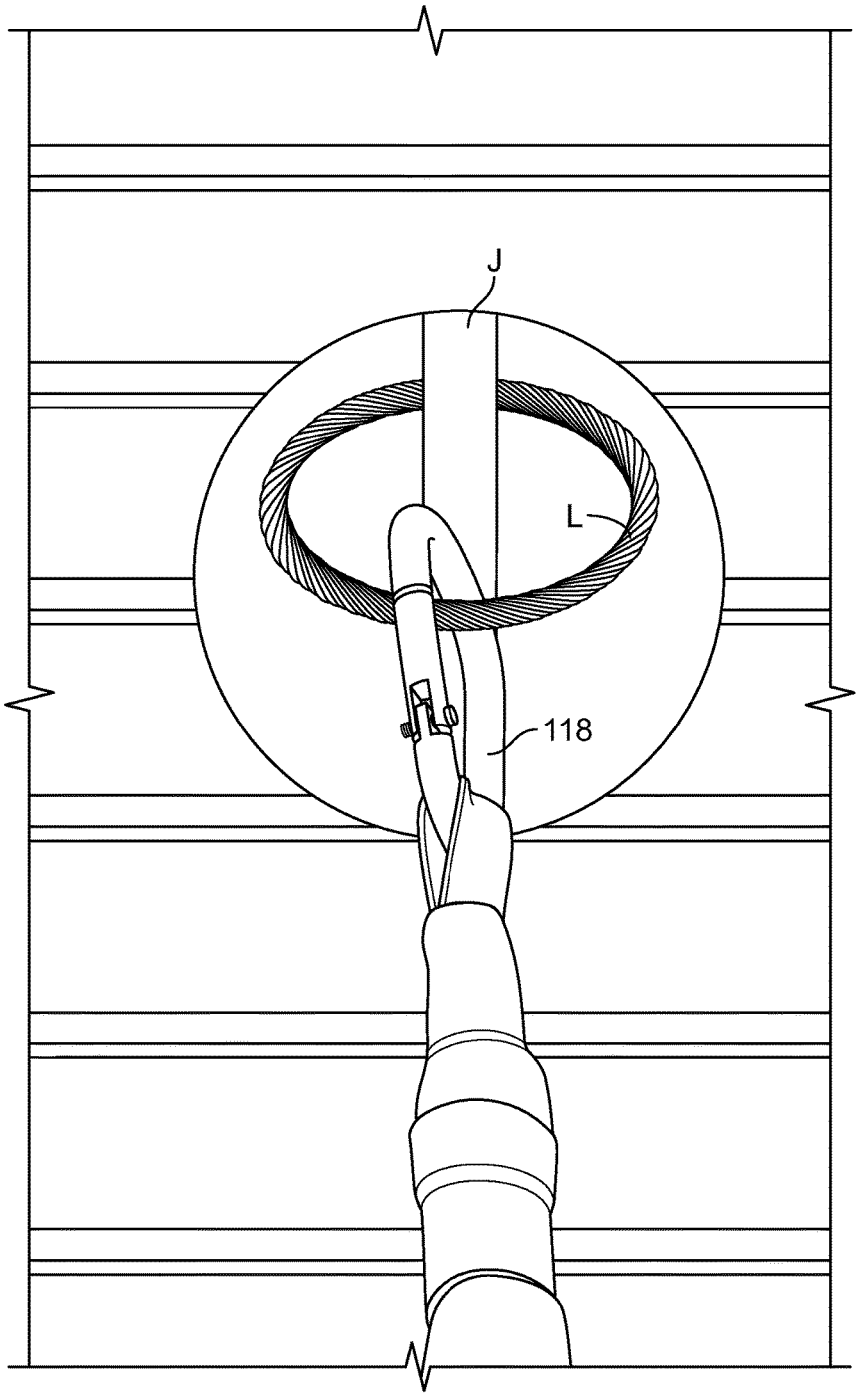
FIG. 4 depicts a close-up view of one method of attaching an exercise band to a support structure in the form of a ceiling.

Various means for providing this attachment may be used. In one example, a sturdy wire loop L is wrapped around a joist J of a structure and a connection member of the exercise band, such as a carabineer 118, is attached to the loop. This configuration is shown in FIG. 4. In other examples the wire may be replaced with eye-bolts or other rigging.

The distance D between support points should be configured such that the exercise bands hang for a participant around hip width apart, or just over. Of course, other configurations are also possible.

Figure 5A:
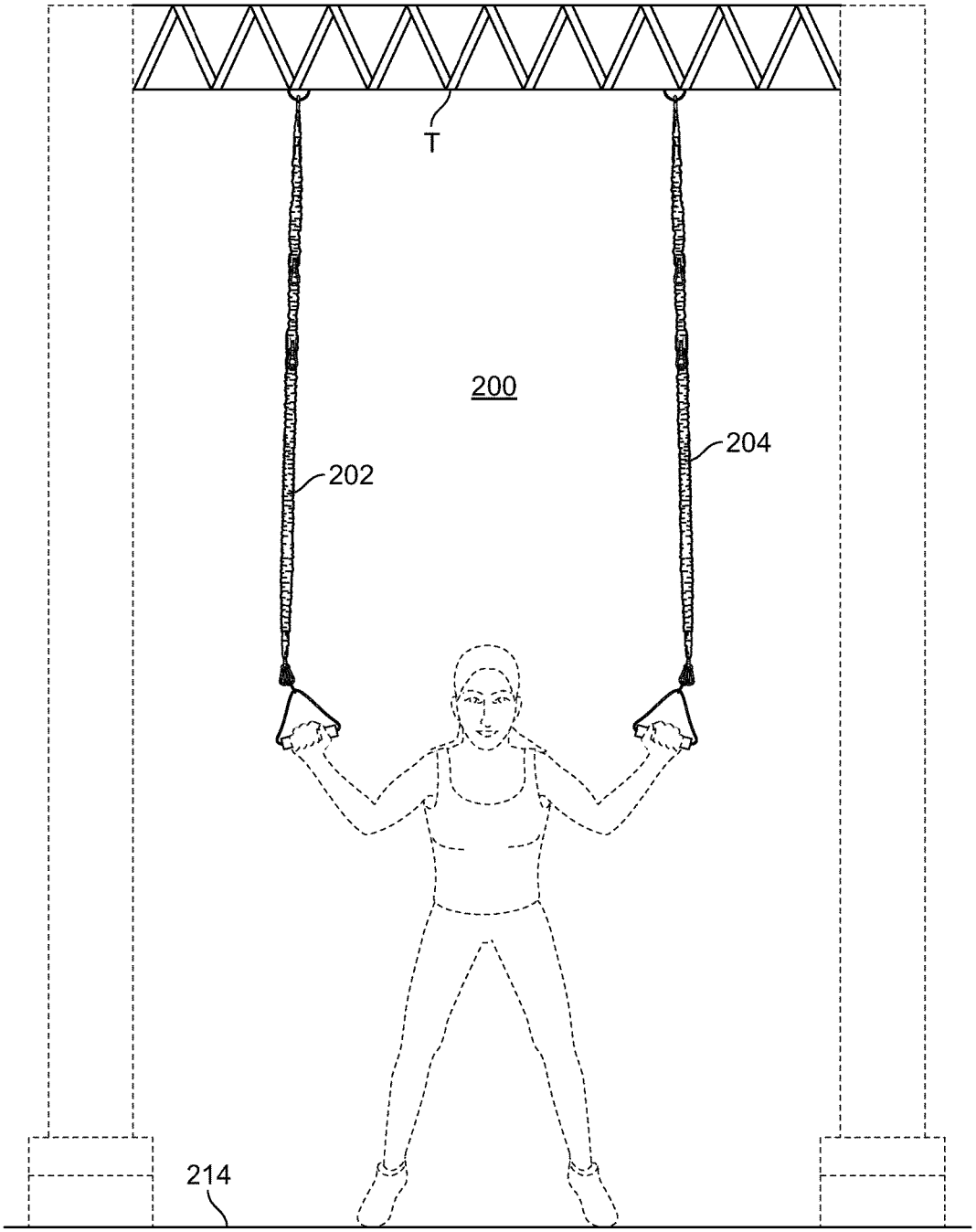
FIG. 5A depicts a frontal view of a support structure and exercise band arrangement in accordance with one embodiment of the present invention.
Figure 5B:
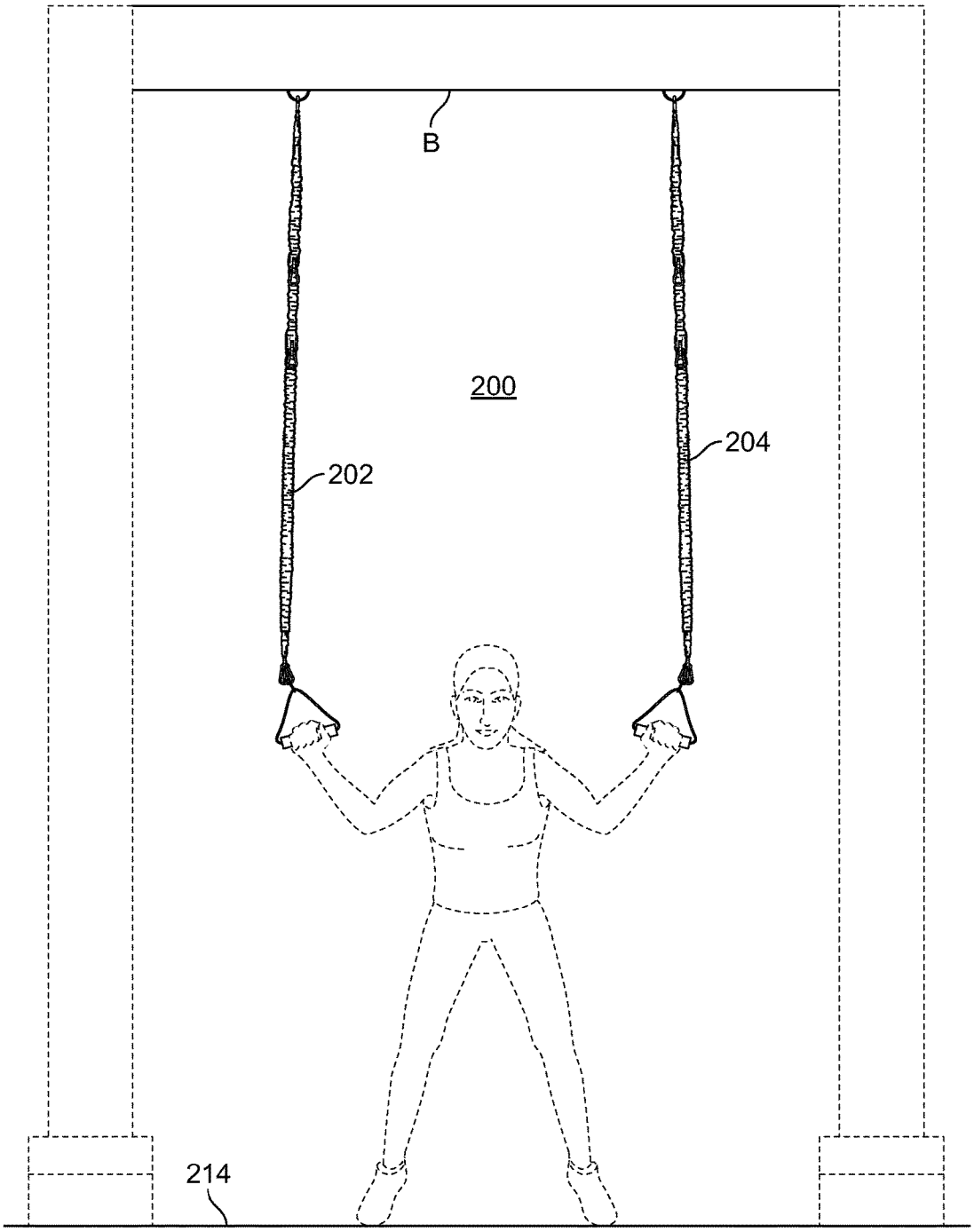
FIG. 5B depicts a frontal view of a support structure and exercise band arrangement in accordance with another embodiment of the present invention.

Supporting structures other than joists may be used and may include floor, such as freestanding, or ceiling supported trusses T, such as shown in FIG. 5A, or floor, such as freestanding, or ceiling mounted bars B, such as shown in FIG. 5B. In such cases, the support structure should be adequate to support the loads of one or more participants without significant swaying or undue stress. It should also be understood that these support structures, being self-contained, may be movable between locations and may be used indoors or outdoors.

It is preferred that the floor 214 be configured such as conventional flooring in martial arts training rooms would be. To date, exercise studios are not so configured and are instead configured with undesirable tile, rubber, wood, or gymnastics spring floor flooring systems. Martial arts training flooring provides softness with impact protection, and is not as "bouncy" as gymnastics spring flooring. Suitable flooring includes polyurethane flooring of the type currently produced by under the Swain trade name by Dollamur Sports Surfaces.

Figure 6:
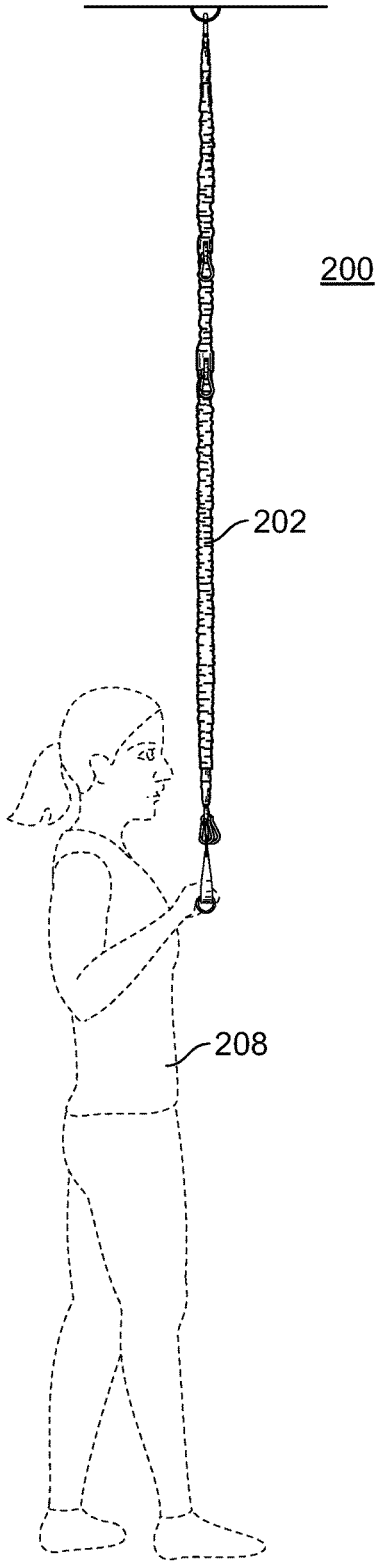
FIG. 6 depicts a side view of the participant of FIG. 3 in a first position.
Figure 7:
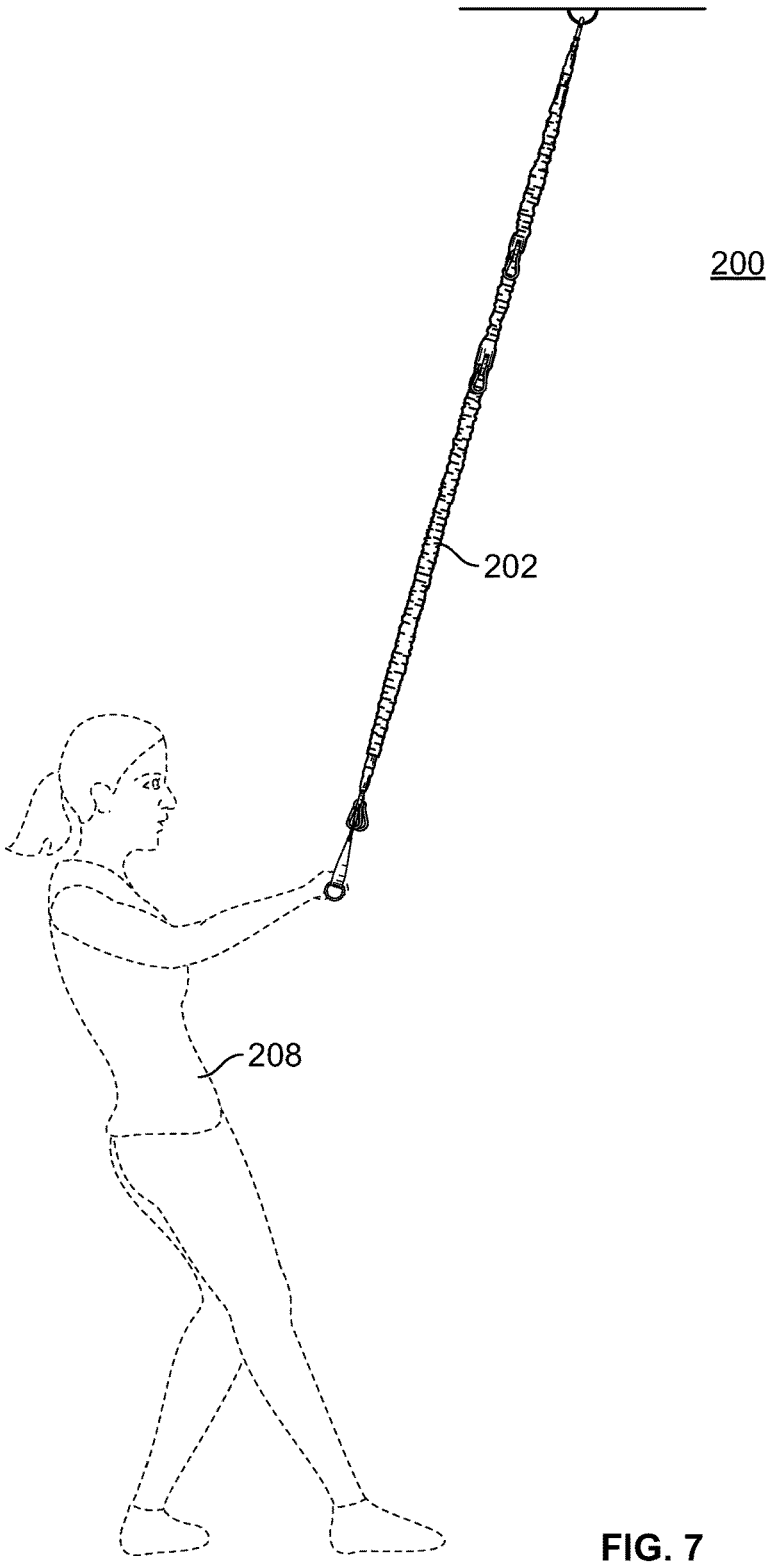
FIG. 7 depicts a side view of the participant of FIG. 3 in a second, pulled forward, position.
Figure 8:
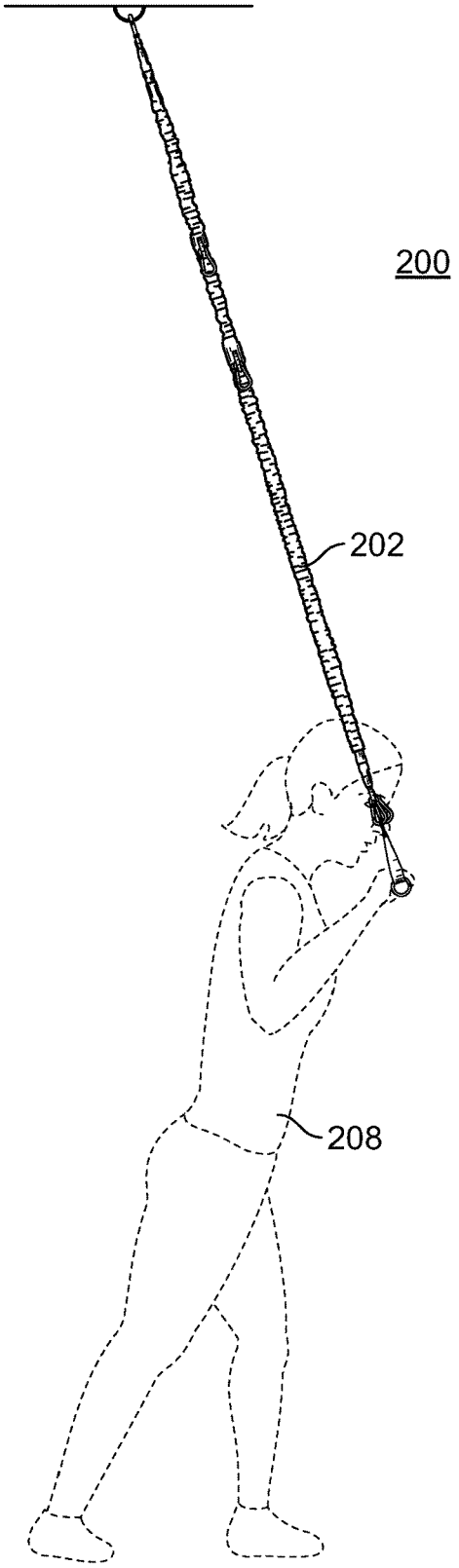
FIG. 8 depicts a side view of the participant of FIG. 3 in a third, pulled back, position.

FIGS. 6-8 depict side views of a representative participant utilizing the facilities shown and discussed with respect to FIG. 3. In FIG. 6, the participant 208 is in the neutral position, such that the bands (only band 202 is shown as the second band is obscured from view) hang in a near vertical orientation. This position allows for certain exercises to be achieved.

FIG. 7 shows a participant 208 in a pulled forward position, where the participant has stepped backward from the neutral position such that the exercise bands 202 extend up and away from the participant to a support, here ceiling 206. In this position, other exercises may be achieved. For example, this position allows for a fairly conventional row type movement.

FIG. 8 shows a participant 208 in a pulled back position, where the participant has stepped forward from the neutral position (and the pulled forward position) such that the exercise bands 202 extend up and in toward the participant on route to a support, such as the ceiling 206 shown. In this position the participant may achieve standard press movements.

Figure 9A:
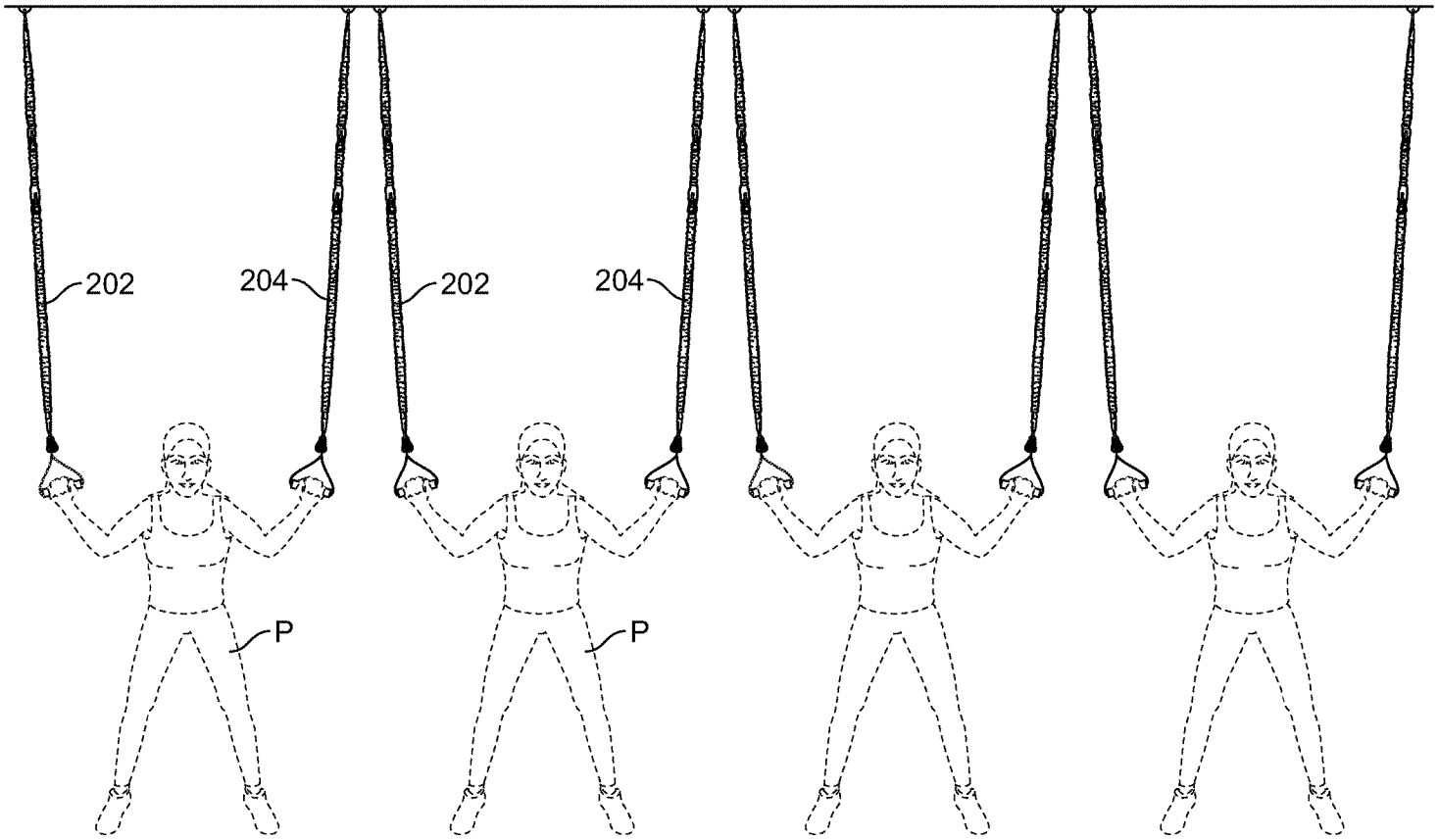
FIG. 9A depicts a front view of a plurality of participants utilizing embodiments of the exercise bands and studio of the present invention, in a first position, all facing the same direction.
Figure 9B:
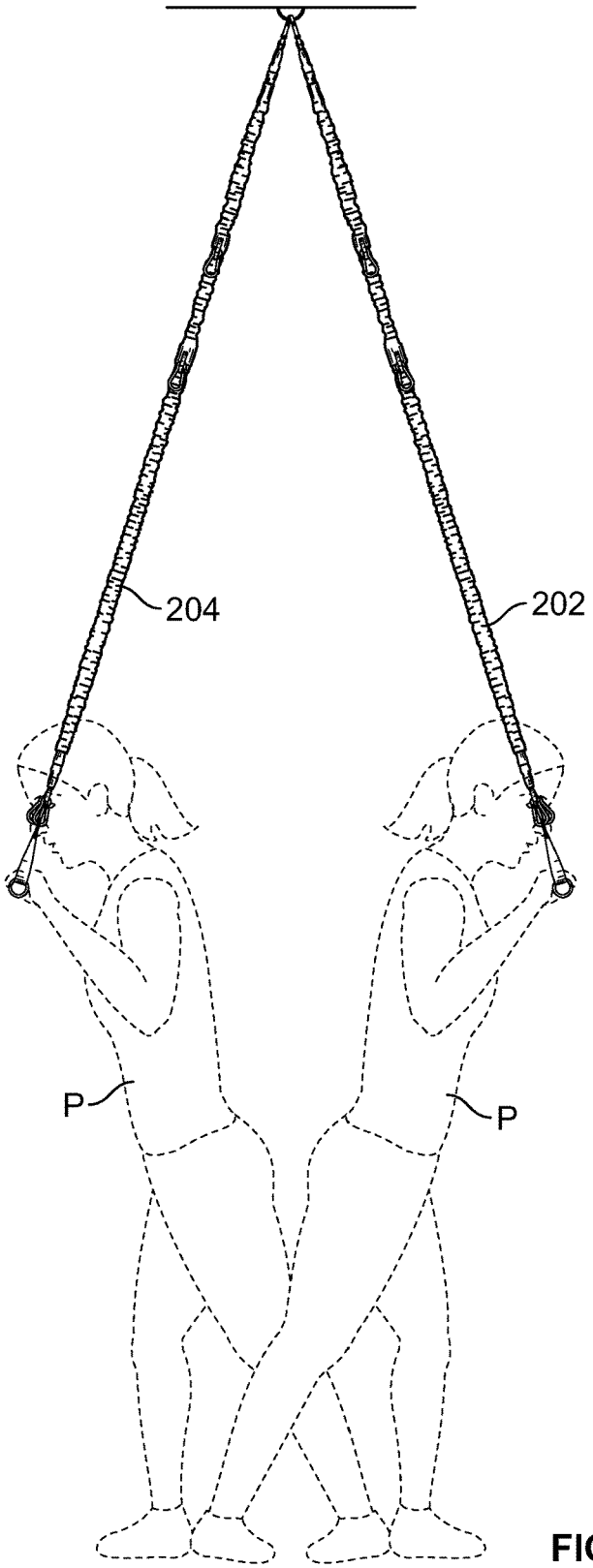
FIG. 9B depicts a side view of the plurality of participants of FIG. 9A, in a second position, and facing opposite directions.
Figure 9C:
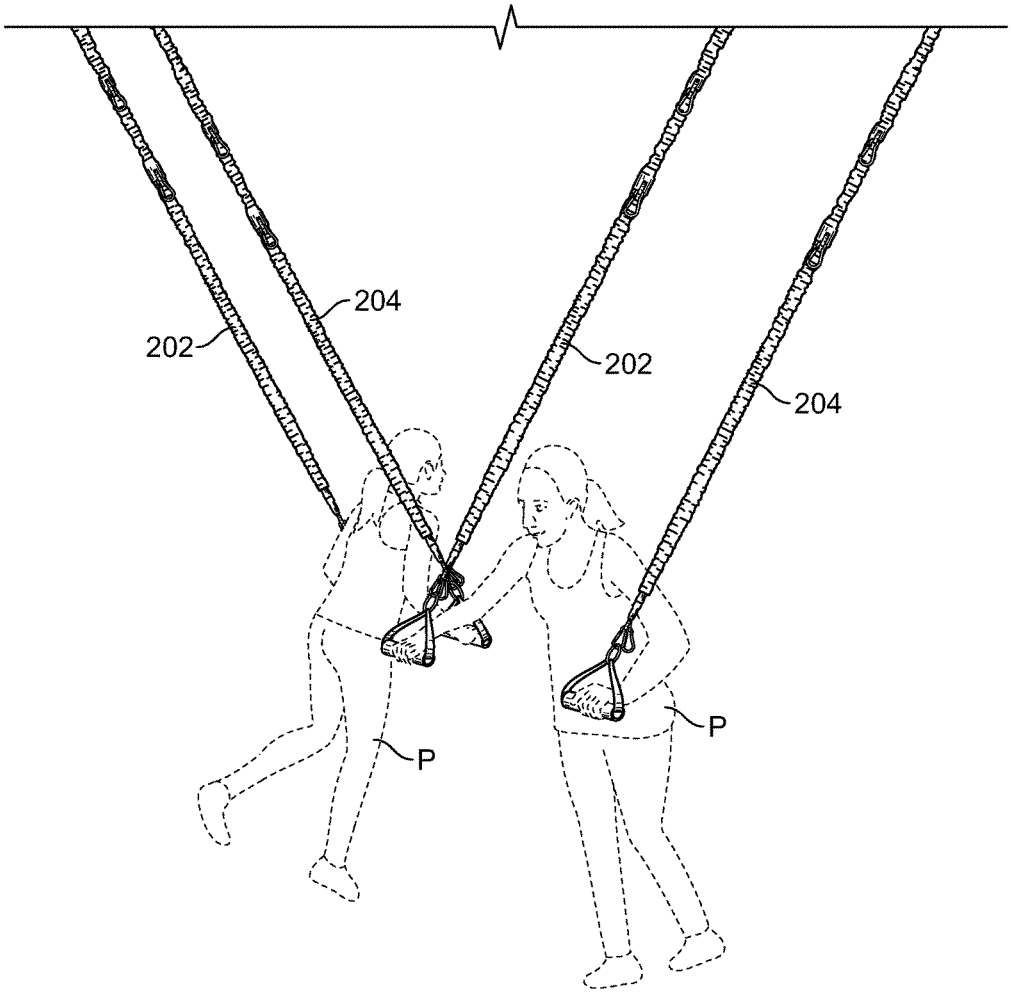
FIG. 9C depicts a perspective view of the plurality of participants of FIG. 9B.

FIGS. 9A, 9B, and 9C show various views of a plurality of participants P in a studio configured with exercise bands 202, 204. It will be appreciated that the participants may move into any of the positions shown in FIGS. 6-8, either in unison, with participants in different positions from one another, or with some participants in similar positions and other participants in different positions.

Although not shown, participants may also move side to side rather than forward and back to achieve different positions. In the course of exercises, these movements may be choreographed and repeated several times over. Other movements where a participant is positioned while lying on the floor may be utilized.

Figure 10:
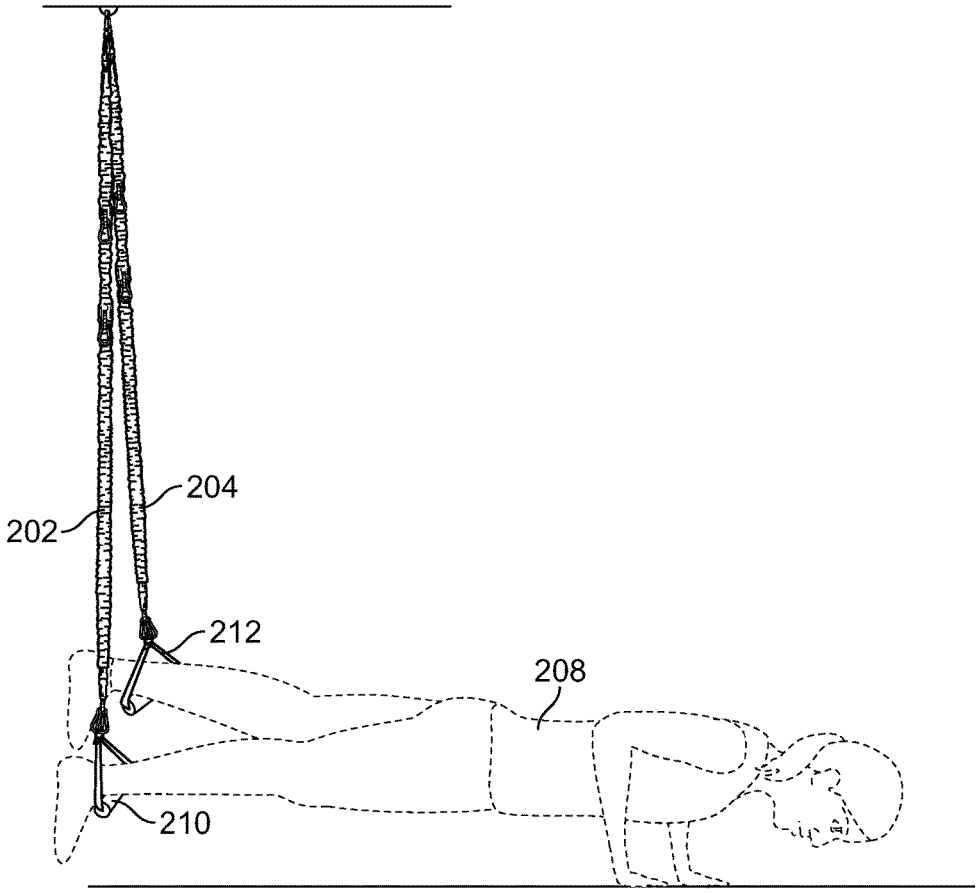
FIG. 10 depicts a participant utilizing the an embodiment of the exercise bands and studio of the present invention in a floating plank position.

For example, one important exercise movement made uniquely available with the inventive exercise bands is shown in FIG. 10. As shown in FIG. 10, the participant 208 is in a plank position with her hands on the floor while her legs are supported above the floor by the exercise bands 202, 204. This arrangement permits floating planks, floating plank jacks where the legs are repetitively spread apart and brought back together, floating pikes with the legs straight and knees brought in toward the chest, and other prone positions and floating movements that rely on the buoyancy achieved when the feet are hooked up to the exercise band. All told, these are exercises that are unique to the present invention. It will be appreciated that in this example, the participant 208 has configured the handles 210, 212 around the participant's feet.

Figure 11:
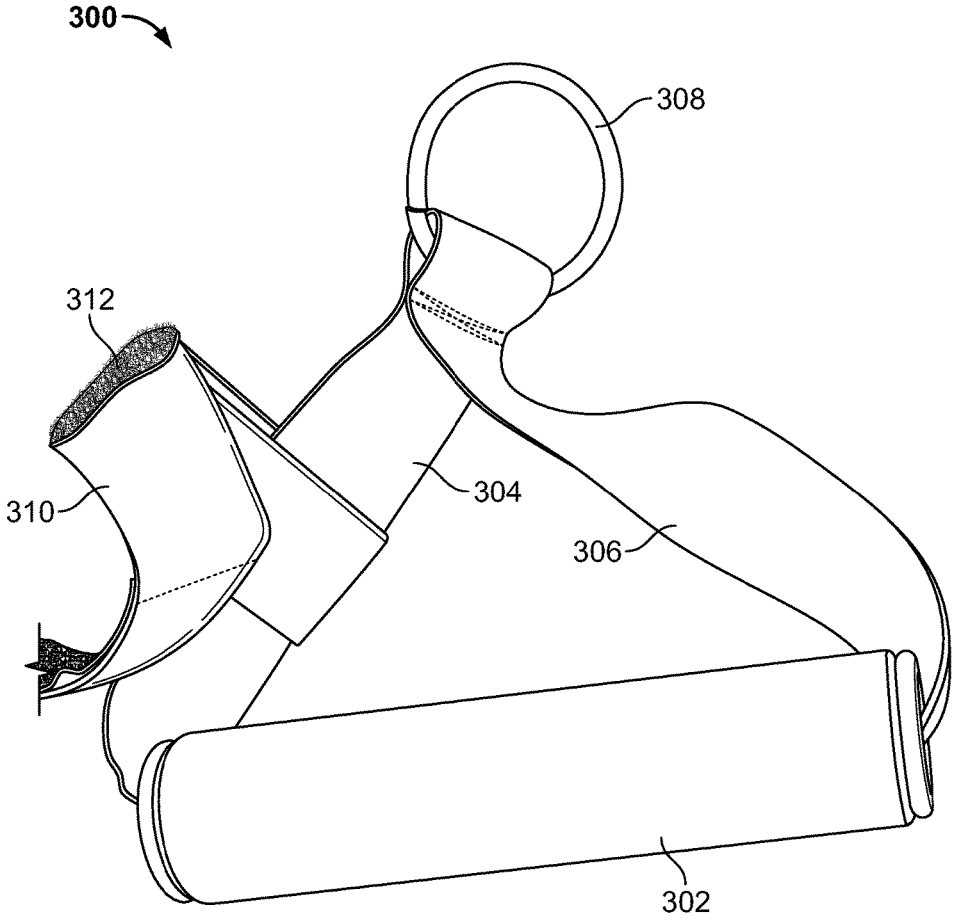
FIG. 11 depicts a perspective view of a handle in accordance with embodiments of the present invention.
Figure 12:
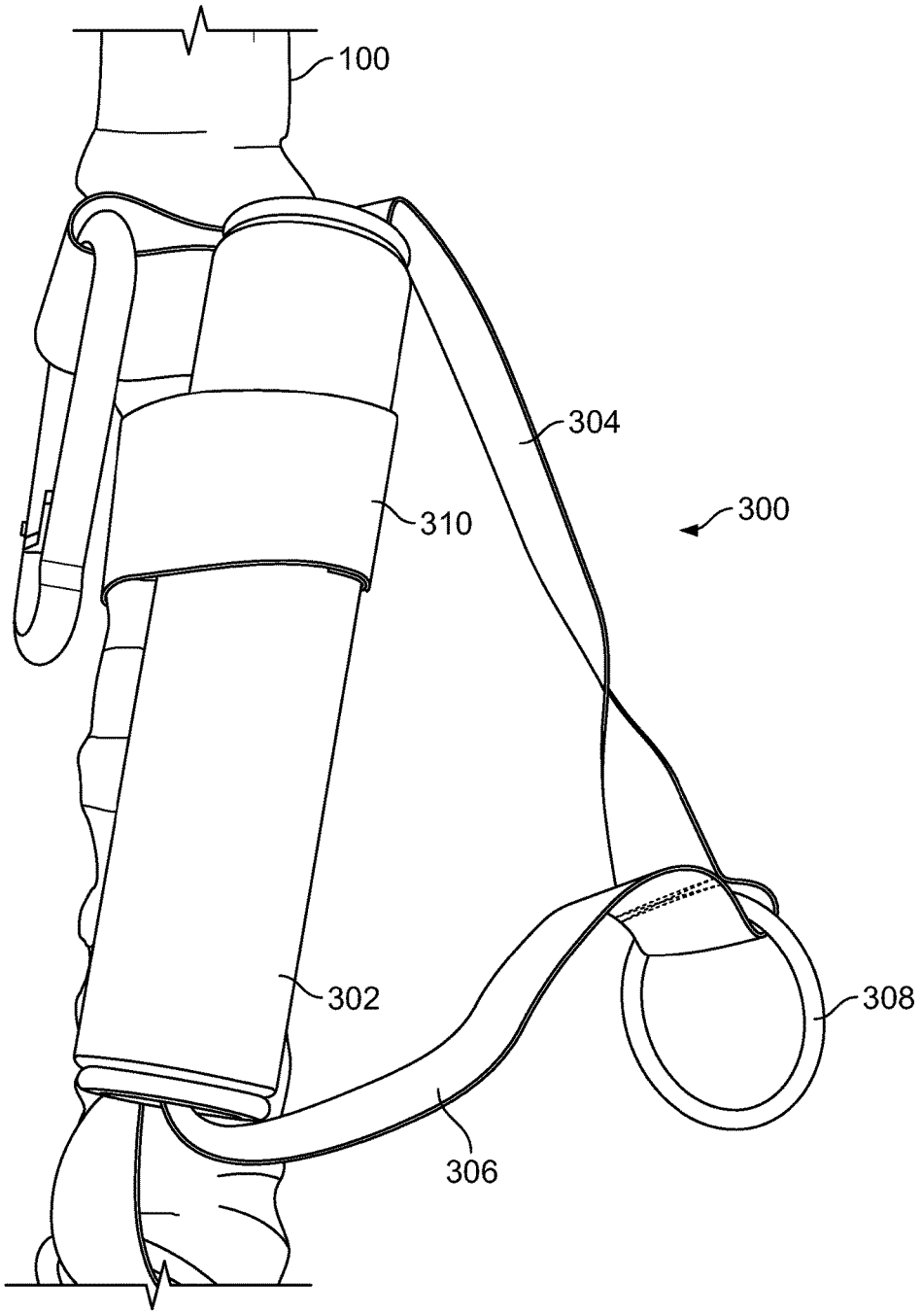
FIG. 12 depicts a perspective view of the handle of FIG. 11 connected to an exercise band.

Exemplary handles are shown in FIG. 11 as handle 300. Handle 300 comprises a foam grip 302 with internal stiff core (not shown). Each end of the foam grip 302 is connected to a strap 304, 306 that triangulates to a single connection at a ring 308, or other suitable connection element. It will be appreciated that the ring 308 may be connected to an attachment mechanism of the exercise band 100, such as attachment mechanisms 106, 120, 122. As shown in FIG. 10, the ring is attached to attachment mechanism 106. By way of example, the rings may be attached to attachment mechanisms 120, 122 in FIG. 3. The handles 300 also may include a strap 310 for tying the handle to the exercise band 100 as shown in FIG. 12. The strap preferably includes hook and loop fastening elements 312 for securing it around the exercise band, particularly when not in use.

Figure 13:
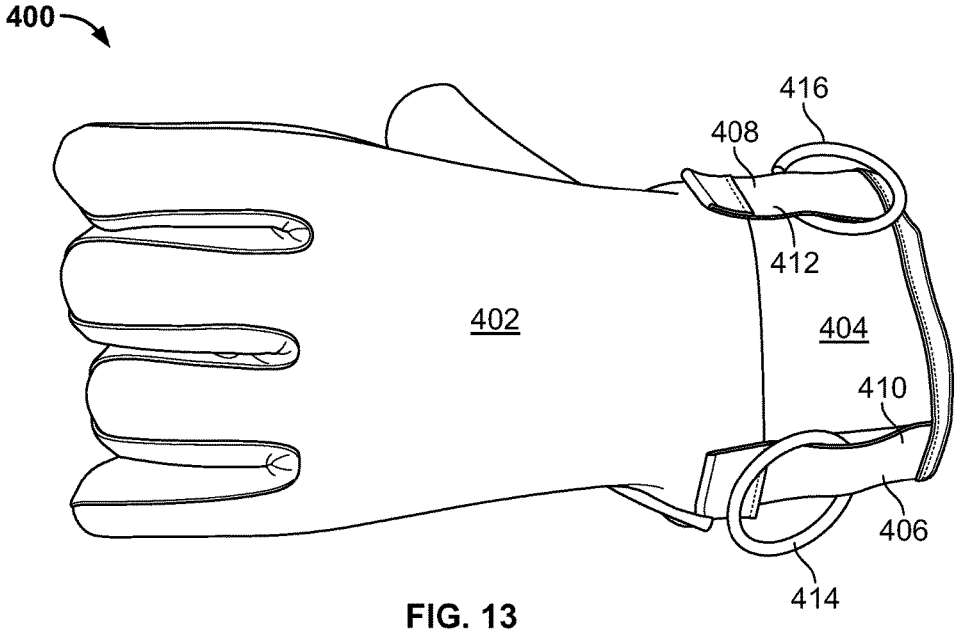
FIG. 13 depicts a glove in accordance with embodiments of the present invention.

FIG. 13 depicts a glove 400 that may be used with the inventive exercise bands 100. The gloves are preferably configured from a thin but strong material, and are not thick like combat gloves. The glove 400 includes a main area 402 that covers the palm, backhand, and fingers (which may be exposed to permit tactical feel). Attached to the main area 402, closer to the wrist, is a cuff 404. The cuff is configured from material which may be somewhat stiffer than the main area 402, and must be tear resistant. Configured with the cuff 404 are a pair of attachment points 406, 408. The attachment points in preferred embodiments are comprised of strips of material 410, 412 sewn at each of their ends to the cuff where a ring 414, 416 is threaded through the material first, and is thereby supported by the material 410, 412.

Positioning of the ring vis-à-vis the hand is critical to reduce the risk of injury. The rings are preferably located such that they are directly adjacent to the pivot point of the wrist, near the joint of the radius and lunate/scaphoid bones, not along the radius and not along the backhand toward the capitate.

It will be appreciated that the gloves 400 may be worn by a participant and connected to the exercise band 100, preferably at a pair of carabineers provided at attachment 106 opposite the support structure. One carabineer is preferably attached to each ring 414, 416. Such an arrangement permits a participant to safely perform aerial and other maneuvers with the added protection of a safety in the event that the participant's grasp is not strong enough to hold the upper band branch handles provided at attachment mechanisms 120, 122 and utilized for specific classes in this series. This also frees up the hand to enable the participant to grasp weights and other objects while the gloves are connected to the exercise bands.

Figure 14A:
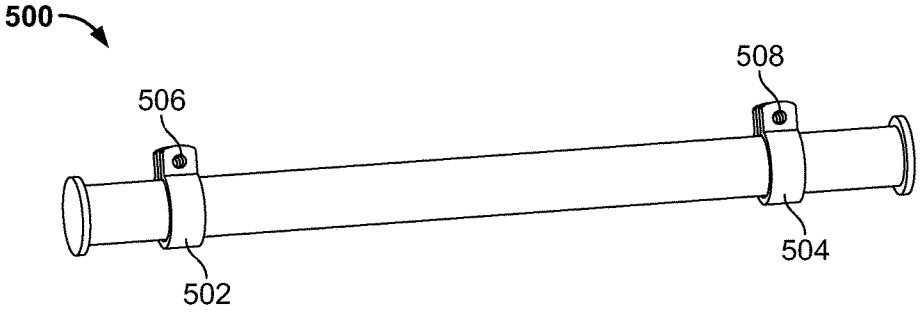
FIG. 14A depicts a bar in accordance with embodiments of the present invention.
Figure 14B:
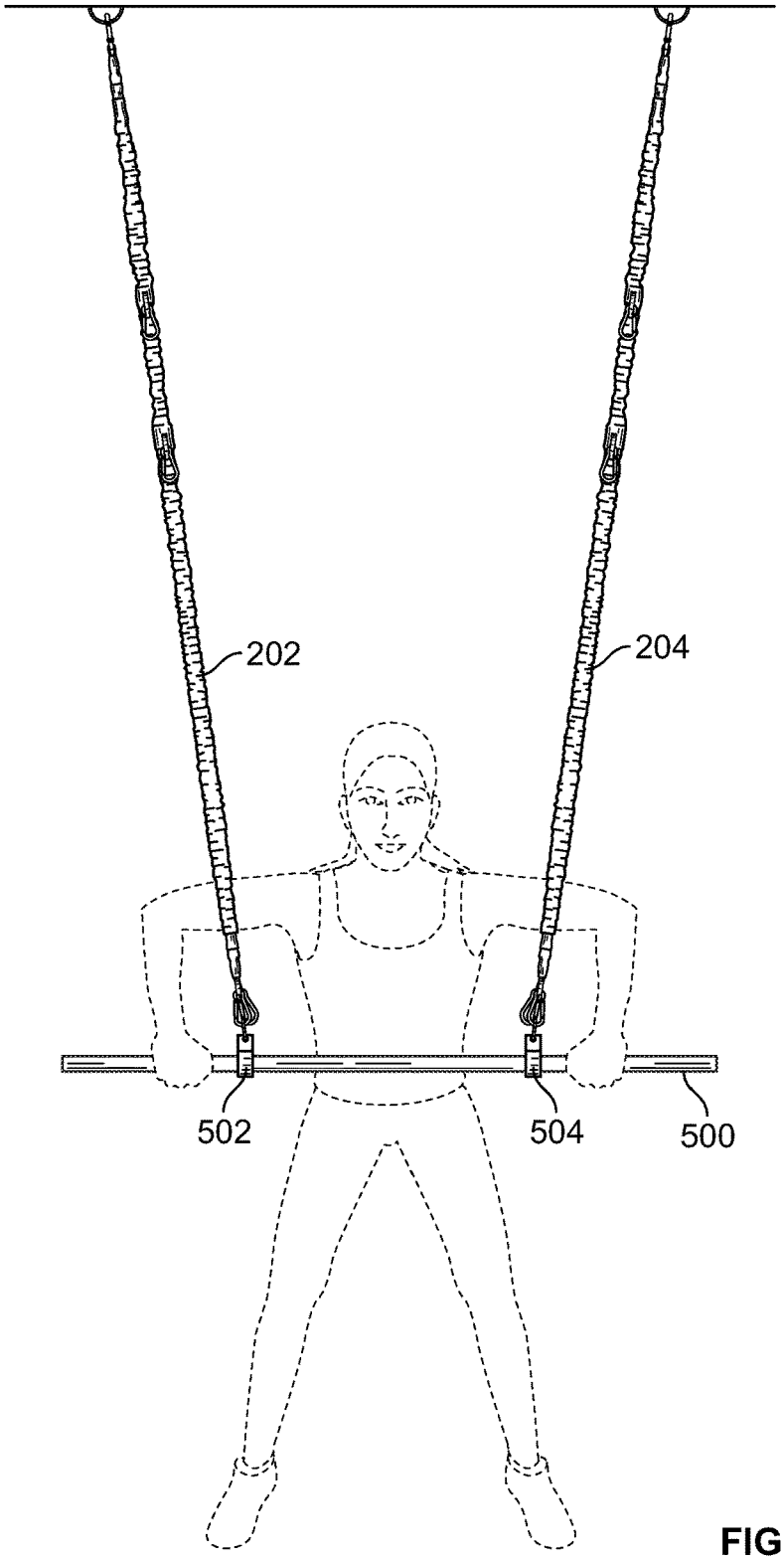
FIG. 14B depicts a participant utilizing exercise bands and the bar of FIG. 14A in accordance with embodiments of the present invention.

Another apparatus that may be used with the exercise bands is a bar 500, as shown in FIG. 14A. The bar 500 is preferably a consistently weighted bar with a weight of between 5 and 10 pounds, with 6 pounds being preferred. The length of the bar is preferably approximately 4' long. The bar 500 includes collars 502, 504 with apertures 506, 508 for connecting attachment mechanisms of the exercise bands 100 thereto. It will be appreciated that carabineers may provide such attachment means. If two carabineers are provided at any single attachment mechanism, only one needs to be utilized. A bar 500 in use is shown in FIG. 14B.

Figure 15:
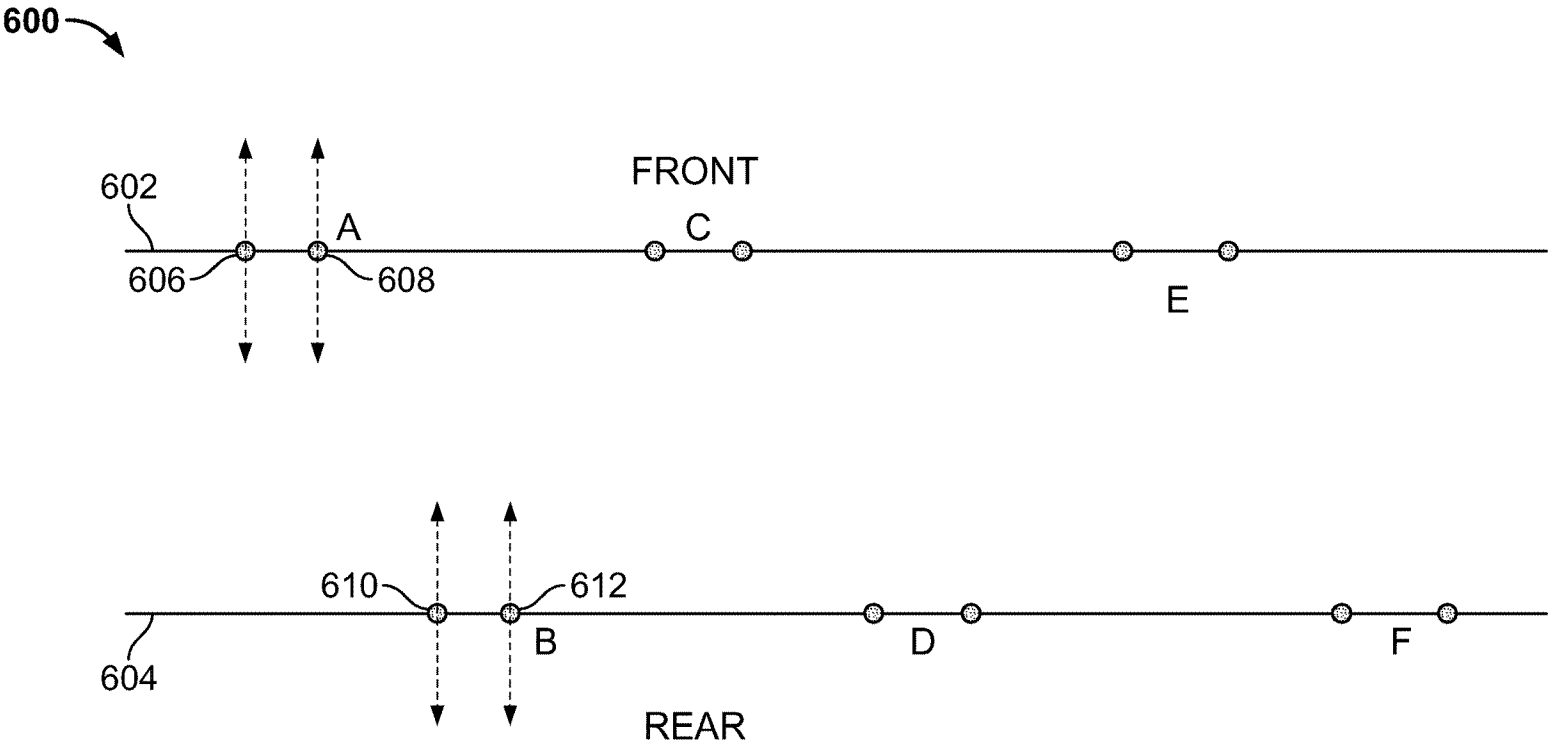
FIG. 15 depicts an overhead view of a typical studio arrangement in accordance with embodiments of the present invention.

As discussed previously with respect to FIGS. 6-8, within an exercise studio there are several possible positions of a participant vis-à-vis the exercise bands including neutral, pulled forward, and pulled back. FIG. 15 expands on this teaching by providing an overhead view of a typical studio arrangement 600. In the studio 600 are a pair of supports 602, 604 extending across the studio above the participants (not shown). The supports may be the actual ceiling or separate supports, such as freestanding structures or structures that use portions of the physical studio for support. Attached to the supports are pairs of exercise bands, A, B, C, D, E, F, etc. . . . With respect to pair A, there are two exercise bands 606, 608 hanging from the support 602. A participant can grasp the two exercise bands 606, 608 at point A and face either toward the front of the room or the rear of the room. Likewise, a second participant may grasp exercise bands 610, 612 at point B and face either the front of the room or the rear of the room. Typically, the direction the participants are facing will be predetermined by an instructor.

Assuming for a moment that the participants are both facing the front of the room, they may start in the neutral position directly below the exercise bands. They may then both move to a pulled forward position by stepping back toward the rear of the room along the arrows shown. They may both move toward a pulled back position by moving forward toward the front of the room along the arrows shown. Likewise, one participant may move to a pulled forward position while the other participant moves to a pulled back position so they are either farther apart, or adjacent to each other. Likewise, they may move side to side.

If the participants are facing each other, such that the first participant at position A is facing the rear of the room and the second participant at position B is facing the front of the room, they can achieve similar results by moving fore or aft in the room in unison or opposite to each other. They may also move side to side.

This array of movements enabled by the staggered pairs of exercise bands permits an instructor to choreograph unique and interesting exercise routines for the participants. The available routines are virtually limitless and are only bound by the imagination of the instructor and skill level of the participants.

It will also be appreciated that the exercise band pairs may be aligned from row to row, so they are not staggered. Other random patterns may also be utilized.

In order to increase the functionality and options of this exercise system, various additional devices may be used in conjunction with the exercise bands. Movements for use with these devices may be provided by an instructor, who usually will also participate in the class and perform the movements as visual examples of the instruction.

Figure 16:
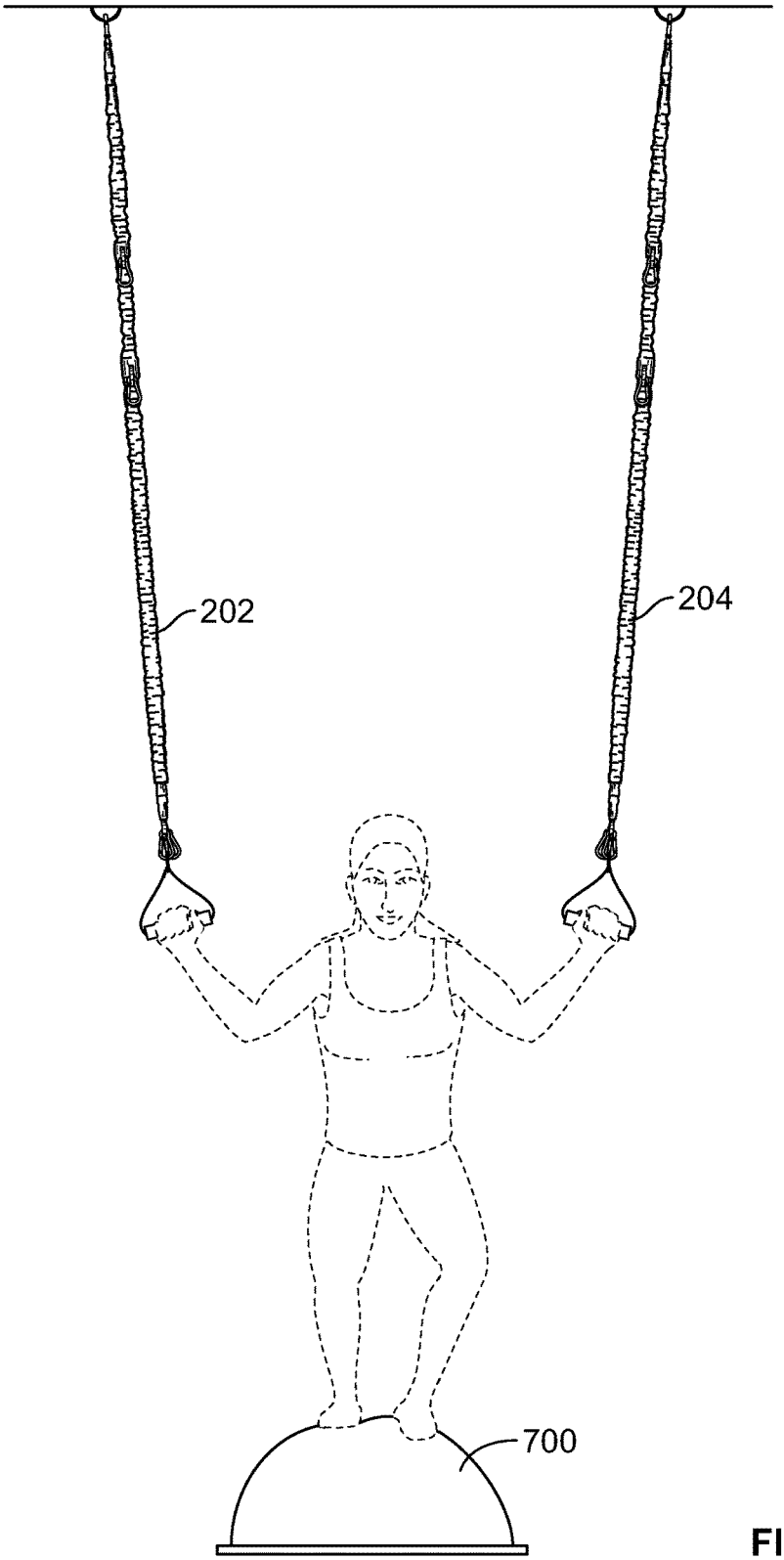
FIG. 16 depicts a participant utilizing exercise bands and an exercise dome in accordance with embodiments of the present invention.

For example, movements may be coordinated for use with an exercise dome 700, similar to a circular version of a step. Such exercise domes may be utilized in their standard configuration with the base down and dome upward, as shown in FIG. 16, or may be turned upside down.

Glide or slide disks (not shown) may also be utilized. Glide/slide disks are typically round plastic disks that may be stepped on to reduce friction between a participant's feet and the flooring surface to permit sliding/gliding forcing the user to use their legs intensely to conduct various movements while their feet are on the slippery disks all the while integrating moves consistent with the exercise bands. With the aid of the exercise bands, unique movements may be made by using the glide disks.

Figure 17:
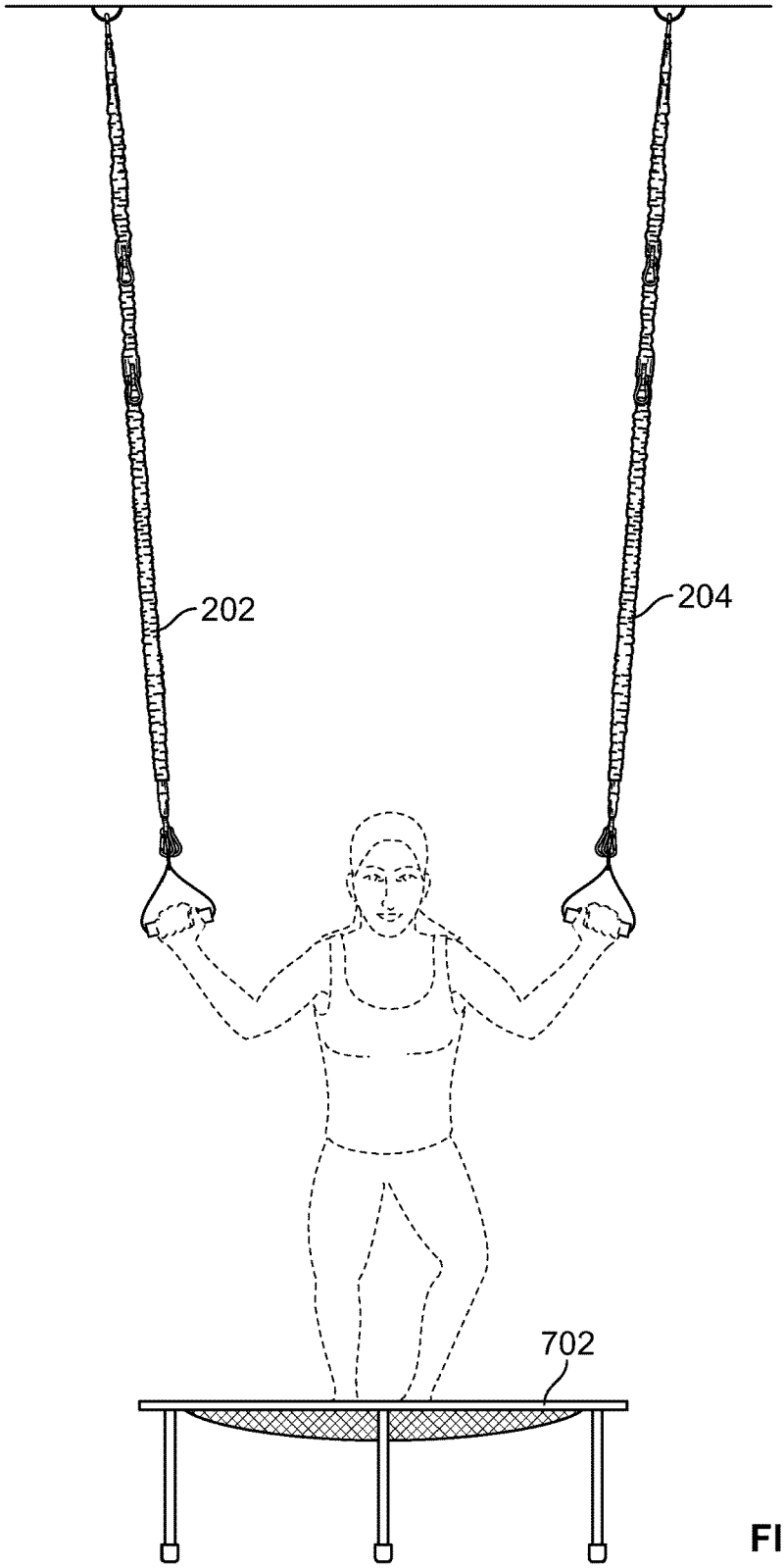
FIG. 17 depicts a participant utilizing exercise bands and a rebounder in accordance with embodiments of the present invention.

Another device that may be utilized with the exercise bands is a rebounder or mini-trampoline 702, as shown in FIG. 17.

Figure 18:
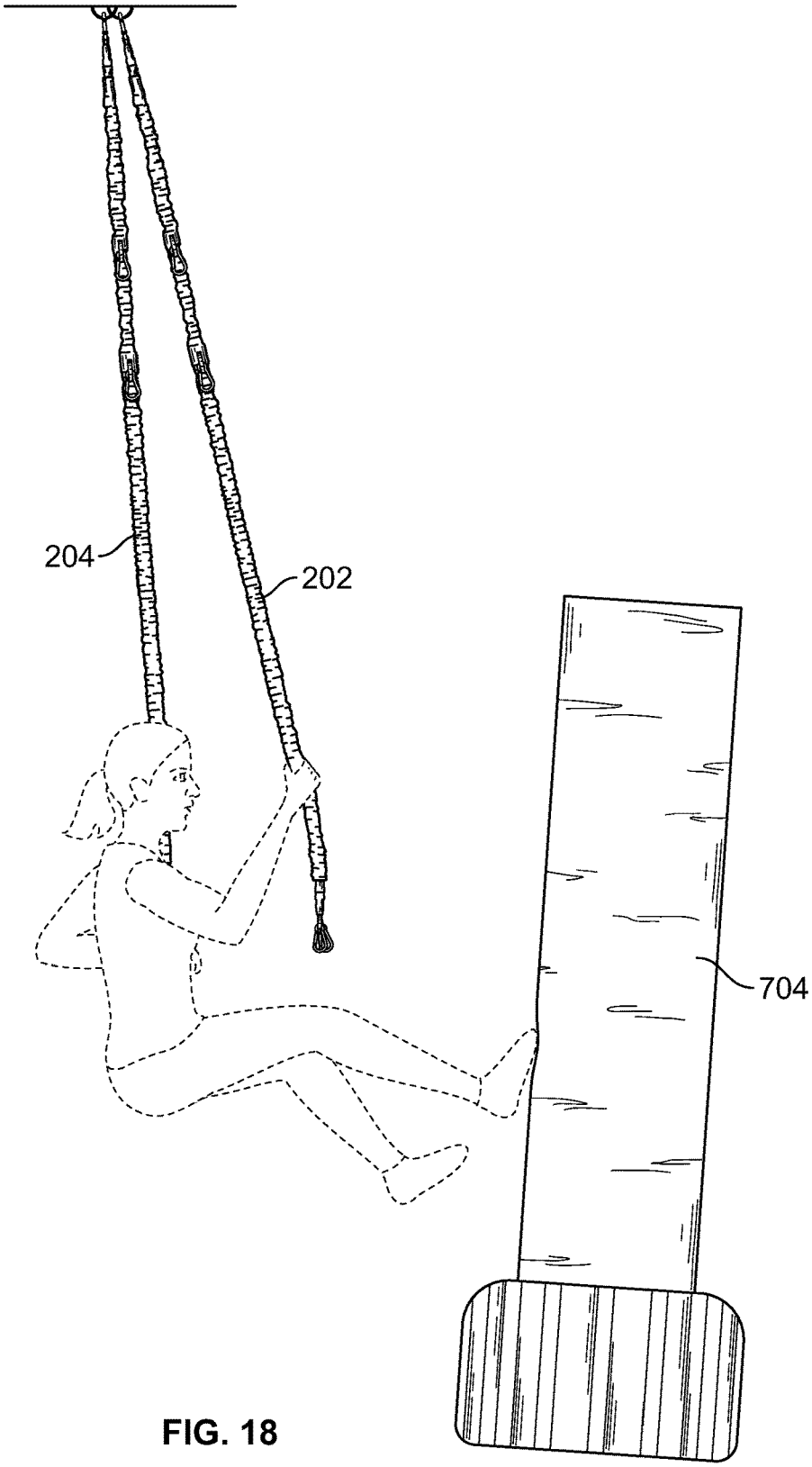
FIG. 18 depicts a participant utilizing exercise bands and a heavy bag in accordance with embodiments of the present invention; and, FIG. 19 depicts a participant utilizing exercise bands and a stationary cycle in accordance with embodiments of the present invention.

Heavy bags 704 may also be used in conjunction with the bands for use with boxing or kick-boxing workouts where the users can scale the bags with buoyancy aid of the exercise bands and thereafter punch or jab with the added resistance provided by the exercise bands. The heavy bags may be freestanding or may be supported by an overhead support, such as the ceiling. A freestanding heavy bag is shown in FIG. 18.

Rollers (not shown) may also be used to create the ability to mimic a surfing action.

Of course, the exercise bands may be used without any additional apparatus. In this manner, the participants may perform unique maneuvers using on the exercise bands themselves, the floor upon which they stand, and even the walls in a climbing manner. These maneuvers include utilizing the buoyancy provided by the bands to perform aerial exercises.

Figure 19:
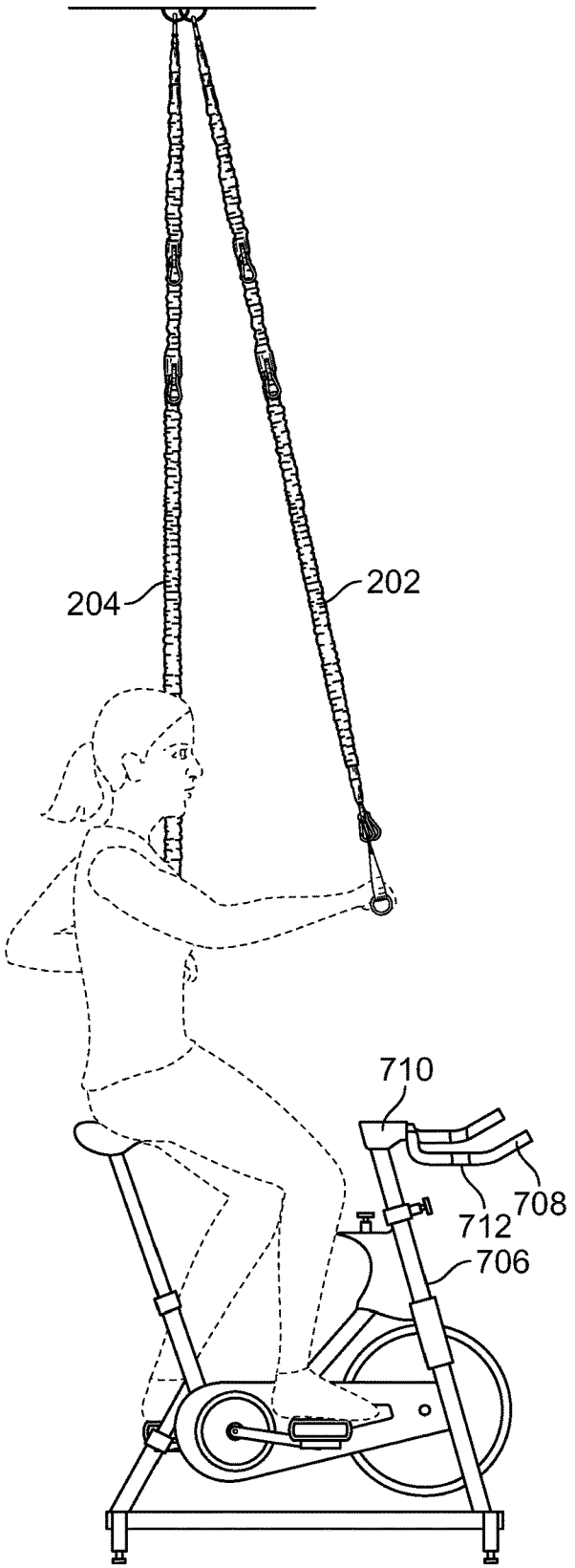

Lastly, one additional apparatus will be discussed. This apparatus is the stationary cycle as shown in FIG. 19. Stationary cycles 706 provide the ability for truly unique and creative movements. In one method of use, the participant can locate the stationary cycle in the neutral position below overhanging exercise straps, as shown in FIG. 19. The participant may then cycle as normal in a cycling class but may add movements coordinated with grasping of the straps. These movements may be pull downs where the straps are elongated against tension provided by the user's arms or twisting motions where the participant twists at the waist. Additionally, the added exercise bands allow for standing cycling movements where participants grasp the unsteady exercise bands instead of the steady handlebars which requires greater core engagement as the individual continues to cycle.

The exercise straps may also be attached to various points on the stationary cycle, such as loops provided on the handlebars 708, stem 710, or other areas to which the carabineers (or other attachment members) at the lower end of the exercise straps may attach. Alternatively, the handlebars or other areas of the stationary cycle may include recesses 712 within which the exercise band may clip onto. The recesses may include a support bar for such purpose. By providing a recess, the attachment member may be partially or fully concealed and therefore will not be intrusive to the participant. An additional manner of attaching the exercise straps to the stationary cycle is by looping the handlebar of a stationary cycle through the handles of an exercise band so equipped.

The participant may then use the stationary cycle without the exercise straps or may conduct interesting movements with the exercise straps still attached. For example, even with the exercise bands attached to the stationary cycle the intermediate connection members (such as connection mechanisms 120, 122) will remain available for grasping.

When the exercise bands are not attached to the stationary cycle, the participant can hold the bands to support their weight while spinning. One movement in this configuration is a downward punch. For example, while spinning the stationary cycle a participant may punch downward with either or both hands grasping the exercise bands.

A participant can also grasp the stationary cycle and the exercise bands simultaneously with both hands, for example using handles provided on the bands. In this configuration, the user can punch downward with one hand, which holds the exercise band, while the other hand holds the stationary cycle and the other exercise band. This movement can then be switched between hands in an alternating manner.

Even with the exercise bands attached to the stationary cycle, a participant can reach up and utilize the exercise bands as leverage to stand up out of saddle of the stationary cycle and with little resistance on the stationary cycle perform a running motion. With heavy resistance, the participant can perform single jumps or steps. It will be appreciated that these techniques require a participant to constantly engage and stabilize her core.

In other configurations, a participant may sit on the saddle of the exercise cycle and with heavy resistance and an eye level grasp of the exercise bands, lean back and pull the bands toward her chest in a row-like manner. This engages the trapezius and deltoid muscles. The participant may also forward lean to engage the core further.

It should also be recognized that exercise bands may be shared between adjacent participants. For example, in a stationary cycling class, where movement of the stationary cycles is cumbersome, participants may change the anchor point angle by utilizing the exercise bands of an adjacent participant. This can them mimic the pulled forward, pulled back, or side to side arrangements previously discussed.

For example, where there are multiple rows of participants on stationary cycles, the cycles may be oriented to face each other. In this orientation, the participants may switch exercise bands so they are no longer grasping exercise bands directly overhead, but are grasping the bands of the participant across from them. Thus each of the users is in a pulled forward position similar to that provided in FIG. 7. Thus, core stabilization and other work is performed by pulling the exercise bands toward the stationary cycle.

In conjunction with the exercise straps and stationary cycles or other apparatuses, it is also envisioned that the studio may be provided with one or more cinema screens for viewing movies, movie clips, television programming, clips of television programming, other videos, photographs, and the like. Instructor suggested movements may be choreographed to the images and videos displayed on the screens. In conjunction with the cinema screens, exercise classes may also be held in conjunction with movie nights to combine the two to further the entertainment experience. The movies may be created by instructors based on approved and/or licensed content of existing movies and television shows, scenic overviews, videos of prior cycling classes, and the like or may be standard movies.

Likewise, the studio may be provided with disco lights, fog machines, scent emitters, and the like to create truly unique exercise scenarios and experiences.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

The invention claimed is:

1. An exercise band comprising:
a first end and a second end;
a covering extending between said first end and said second end;
an internal resistance member positioned within said covering, said internal resistance member being resilient between said first end and said second end;
a connection member fixedly attached to said covering, said connection member adapted for a connection of user accessories to said exercise band;
wherein said internal resistance member slides freely within said covering adjacent to said connection member, and wherein a ring substantially external to said covering at said first end is directly connected to said internal resistance member at a connection point located within said covering.

2. The exercise band of claim 1, wherein said covering is gathered in a non-tensioned length of said exercise band.

3. The exercise band of claim 2, wherein said covering is not gathered in a fully tensioned length of said exercise band, said covering serving to limit tensioning of said internal resistance member.

4. The exercise band of claim 3, wherein said internal resistance member is configured to support a full weight of a human exercise participant without reaching said fully tensioned length.

5. The exercise band of claim 1, wherein said covering is a cloth covering.

6. The exercise band of claim 1, wherein said internal resistance member is a plurality of internal resistance members.

7. An exercise environment comprising: a floor, one or plural overhead supports; and one or plural exercise bands as claimed in claim 1 hanging from said one or plural overhead supports;
wherein each of said one or plural exercise bands has a length and said connection member of each of said one or plural exercise bands is positioned at a point approximately ⅓ of the length of said one or plural exercise bands from said one or plural overhead supports.

8. The exercise environment of claim 7, wherein said one or plural overhead supports is a self-standing support.

9. The exercise environment of claim 8, wherein said one or plural exercise bands is multiple pairs of exercise bands arranged in rows.

10. The exercise environment of claim 7, further comprising a stationary cycle associated with said one or plural exercise bands.

11. The exercise band of claim 1, wherein said exercise band further comprises a second connection member attached to said covering, said second connection member adapted for the connection of the user accessories to said exercise band.

12. The exercise band of claim 1, wherein said connection member is attached to said covering by sewing or chemical bonding.

13. An exercise environment comprising:
an overhead support;
a floor;
a pair of exercise bands, each exercise band of said pair of exercise bands having
a first end and a second end;
a covering extending between said first end and said second end;
an internal resistance member positioned within said covering, said internal resistance member being resilient between said first end and said second end;
a connection member fixedly attached to said covering, said connection member adapted for a connection of user accessories to said exercise band;
wherein said internal resistance member slides freely within said covering adjacent to said connection member, and wherein a ring substantially external to said covering at said first end is directly connected to said internal resistance member at a connection point located within said covering.

14. The exercise environment of claim 13, wherein said each of said pair of exercise bands further comprises a second connection member attached to said covering, said second connection member adapted for the connection of the user accessories to said exercise band.

15. The exercise environment of claim 14, wherein said covering of each of said exercise bands of said pair of exercise bands is gathered in a non-tensioned length of said exercise band and is not gathered in a fully tensioned length of said exercise band, said covering serving to limit tensioning of said internal resistance member.

16. The exercise band of claim 15, wherein each of said exercise bands of said pair of exercise bands is configured to support a full weight of a human exercise participant without reaching its said fully tensioned length, whereby said exercise band remains resilient.

17. The exercise environment of claim 15, wherein said internal resistance member of each exercise band of said pair of exercise bands slides freely within said covering adjacent said connection members.

18. An exercise environment comprising:
an overhead support;
a floor;
a first exercise band, said first exercise band consisting of:
a first end and a second end;
a covering extending between said first end and said second end;
an internal resistance member positioned within said covering so as to slide freely therein between said first end and said second end, said internal resistance member being resilient between said first end and said second end with a consistent spring constant;
a pair of connection members attached to said covering, said pair of connection members adapted for a connection of user accessories to said first exercise band;
a second exercise band, said second exercise band consisting of:
a first end and a second end;
a covering extending between said first end and said second end;
an internal resistance member positioned within said covering so as to slide freely therein between said first end and said second end, said internal resistance member being resilient between said first end and said second end with a consistent spring constant;

a pair of connection members fixedly attached to said covering, said connection members adapted for the connection of the user accessories to said second exercise band.

19. The exercise environment of claim 18, wherein said first and said second exercise bands are each configured to support a full weight of a human exercise participant while remaining resilient between respective first and second ends.

* * * * *